US011119423B2

(12) United States Patent
Kitan

(10) Patent No.: US 11,119,423 B2
(45) Date of Patent: Sep. 14, 2021

(54) PHOTOSENSITIVE MEMBER UNIT AND IMAGE FORMING APPARATUS

(71) Applicant: CANON KABUSHIKI KAISHA, Tokyo (JP)

(72) Inventor: Tomonori Kitan, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/850,113

(22) Filed: Apr. 16, 2020

(65) Prior Publication Data

US 2020/0341402 A1 Oct. 29, 2020

(30) Foreign Application Priority Data

Apr. 25, 2019 (JP) ..... JP2019-084269

(51) Int. Cl.
*G03G 15/02* (2006.01)

(52) U.S. Cl.
CPC ..... *G03G 15/0216* (2013.01)

(58) Field of Classification Search
CPC ..... G03G 15/0216
See application file for complete search history.

(56) References Cited

U.S. PATENT DOCUMENTS 5,666,608 A * 9/1997 Christensen ..... G03G 15/0216 399/115
6,385,420 B1 * 5/2002 Morioka ..... G03G 15/0216 399/115
8,210,530 B1 * 7/2012 Gayne ..... G03G 15/0813 271/273
8,706,006 B2 * 4/2014 Kim ..... G03G 21/1814 399/115
2007/0098438 A1 * 5/2007 Yamaguchi ..... G03G 21/1857 399/111
2007/0248382 A1 * 10/2007 Oguma ..... G03G 15/0216 399/167
2014/0086630 A1 * 3/2014 Kitajima ..... G03G 15/0233 399/111
2016/0216688 A1 * 7/2016 Katayama ..... G03G 21/1814
2016/0252878 A1 * 9/2016 Kimura ..... G03G 21/1814 399/176
2020/0096891 A1 * 3/2020 Yamamoto ..... G03G 15/0216

FOREIGN PATENT DOCUMENTS

JP 2002-311690 A 10/2002

* cited by examiner

*Primary Examiner* — G. M. A Hyder
(74) *Attorney, Agent, or Firm* — Venable LLP

(57) ABSTRACT

A photosensitive member unit includes a photosensitive member, a rotary member, a charging roller, a separating member, and a one-way clutch. The charging roller is moved to and positioned at a separated position in a case where the photosensitive member rotates in a second direction when the separating member is positioned at a first position. The charging roller is moved to and positioned at a contact position in a case where the photosensitive member rotates in a first direction when the separating member is positioned at a second position.

15 Claims, 13 Drawing Sheets

PHOTOSENSITIVE MEMBER UNIT AND IMAGE FORMING APPARATUS

BACKGROUND OF THE INVENTION

Field of the Invention

The present invention relates to a photosensitive member unit and an image forming apparatus forming an image on a recording material by utilizing an electrophotographic system or an electrostatic recording system.

Description of the Related Art

Hitherto, a contact charging system has been widely used as a primary charging method of an image forming apparatus of an electrophotographic system. In the contact charging method, a charging roller in which a conductive elastic layer is provided on an outer circumference of a conductive supporting member serving as a core metal and in which a resistant layer is coated on an outer circumference of the conductive elastic layer is used. That is, the charging roller is brought into contact with a photosensitive member such as a photosensitive drum by an urging spring or the like urging the charging roller to the photosensitive member. Then, the charging roller is applied with voltage and charges a surface of the photosensitive member by causing a minute electric discharge in a vicinity of a contact nip portion where the charging roller is in contact with the photosensitive member. Still further, those members such as the photosensitive member and the charging roller being made into a cartridge as a photosensitive member unit is widespread.

If the charging roller is left in contact with the photosensitive member for a long period of time in such photosensitive member unit constructed as described above, there is a possibility of causing image defects in forming an image by the following reasons. That is, there is a case where a part of the charging roller in contact with the photosensitive member is deformed due to the long-term contact or a case where a contact trace or the like is left at the part where the photosensitive member is in contact with the charging roller. Image defects may occur in forming an image in such cases.

In order to restrain occurrence of such image defects, there is known a photosensitive member unit including a separating member capable of switching a contact state and a separate state of the photosensitive member and the charging roller as disclosed in Japanese Patent Application Laid-open No. 2002-311690. In the photosensitive member unit, the separating member is disposed in parallel with a pressurizing direction of the charging roller when the photosensitive member is stopped from rotating in forming no image or the like. Because the charging roller is pressed in a direction reverse to the pressurizing direction, the charging roller is separated from the photosensitive member.

Then, as the photosensitive member is rotationally driven in a normal direction in forming an image or the like, the separating member rotates by being dragged centering on a shaft of the charging roller by an engagement of a gear portion, i.e., an engagement portion, of the photosensitive member and a gear portion of the charging roller. Then, the separating member that has been supporting the charging roller separately from the photosensitive member recedes from a part between the separating member and the photosensitive member, and the charging roller is urged by an urging spring toward the photosensitive member such that the charging roller comes into contact with the photosensitive member. When the photosensitive member is stopped to rotate in finishing an operation of forming an image or the like, the image forming apparatus rotates the photosensitive member in a reverse direction. Thereby, the gear portion of the photosensitive member engages with the gear portion of the separating member and the separating member rotates in a direction reverse to a normal operation. Then, the charging roller separates from the photosensitive member.

In the photosensitive member unit described in Japanese Patent Application Laid-open No. 2002-311690, however, the gear portion of the separating member is always in contact with the gear portion of the photosensitive member even when the charging roller is in contact with the photosensitive member and idles when the photosensitive member rotates. Due to that, because own weight of the separating member acts on a rotary member, the separating member vibrates as the rotary member rotates. Thus, there is a possibility of giving vibration to the photosensitive member in forming an image and of causing image defects such as image pitch irregularity. Meanwhile, it has been demanded lately to improve accuracy of a width of the contact nip between the charging roller and the photosensitive member due to an increase of an image forming speed and to cost reduction or the like by DC-conversion of charging high-voltage power supply. That is, it has been demanded to eliminate unwanted disturbances such as the vibration in forming an image.

Accordingly, the present disclosure aims at providing a photosensitive member unit and an image forming apparatus capable of, even though capable of switching contact and separate states of a photosensitive member and a charging roller by a separating member, restraining vibration of a photosensitive member otherwise caused by the separating member coming into contact with an engagement portion of the photosensitive member in forming an image.

SUMMARY OF THE INVENTION

According to a first aspect of the present invention, a photosensitive member unit includes a photosensitive member configured to rotate in a first direction while bearing an electrostatic image in forming an image and in a second direction opposite to the first direction, a rotary member configured to rotate integrally with the photosensitive member and comprising a first engagement portion on an outer circumferential portion of the rotary member, a charging roller configured to move to a separate position in which the charging roller is separated from a surface of the photosensitive member and a contact position in which the charging roller is brought into contact with the surface of the photosensitive member, the charging roller being configured to be driven by the photosensitive member at the contact position and charge the surface of the photosensitive member by being applied with voltage, a separating member comprising a second engagement portion engageable with the first engagement portion and configured to move to a first position and a second position along with rotation of the charging roller, the first position being a position where the second engagement portion separates from the first engagement portion and the separating member allows the charging roller to be positioned at the contact position, the second position being a position where the second engagement portion engages with the first engagement portion and the separating member positions the charging roller at the separate position, and a one-way clutch interposed between the charging roller and the separating member in a power transmission path, the one-way clutch being configured to transmit rotation of the charging roller to the separating member in a case where the photosensitive member rotates in the second direction, the one-way clutch being configured to transmit rotation of the charging roller to the separating member or idle the charging roller with respect to the separating member in a case where the photosensitive member rotates in the first direction. The charging roller is moved to and positioned at the separate position in a case where the photosensitive member rotates in the second direction when the separating member is positioned at the first position. The charging roller is moved to and positioned at the contact position in a case where the photosensitive member rotates in the first direction when the separating member is positioned at the second position.

According to a second aspect of the present invention, a photosensitive member unit includes a photosensitive member configured to rotate in a first direction while bearing an electrostatic image in forming an image and in a second direction opposite to the first direction, a rotary member configured to rotate integrally with the photosensitive member and comprising a first engagement portion on an outer circumferential portion of the rotary member, a charging roller configured to move to a separate position in which the charging roller is separated from a surface of the photosensitive member and a contact position in which the charging roller is brought into contact with the surface of the photosensitive member, the charging roller being configured to be driven by the photosensitive member at the contact position and charge the surface of the photosensitive member by being applied with voltage, a separating member comprising a second engagement portion engageable with the first engagement portion and configured to move to a first position and a second position along with rotation of the charging roller, the first position being a position where the second engagement portion separates from the first engagement portion and the separating member allows the charging roller to be positioned at the contact position, the second position being a position where the second engagement portion engages with the first engagement portion and the separating member positions the charging roller at the separate position, and a torque limiting portion interposed between the charging roller and the separating member in a power transmission path, the torque limiting portion being configured to transmit a torque from the charging roller to the separating member in a case where the photosensitive member rotates in the second direction, the torque limiting portion being configured to limit transmission of torque from the charging roller to the separating member in a case where the photosensitive member rotates in the first direction. The charging roller is moved to and positioned at the separate position in a case where the photosensitive member rotates in the second direction when the separating member is positioned at the first position. The charging roller is moved to and positioned at the contact position in a case where the photosensitive member rotates in the first direction when the separating member is positioned at the second position.

Further features of the present invention will become apparent from the following description of exemplary embodiments with reference to the attached drawings.

DESCRIPTION OF THE EMBODIMENTS

First Embodiment

A first embodiment of the present disclosure will be described in detail with reference to FIGS. 1 through 12. A tandem type full-color printer will be described as one example of an image forming apparatus in the present embodiment. However, the present disclosure is not limited to what is mounted in the tandem type image forming apparatus 1 and may be what is mounted in another type image forming apparatus. The present disclosure is not also limited to what is mounted in a full-color printer and may be mounted in a monochrome or a mono-color printer. Alternatively, the present disclosure can be carried out in various uses such as a printer, various printing machines, a copier, a fax machine and a multi-function printer. Note that a sheet S is a recording material on which a toner image is formed and specifically includes a plain sheet of paper, a synthetic resin-made sheet that is a substitute of the plain sheet of paper, a thick sheet, an overhead projector sheet and the like.

Image Forming Apparatus

Figure 1:
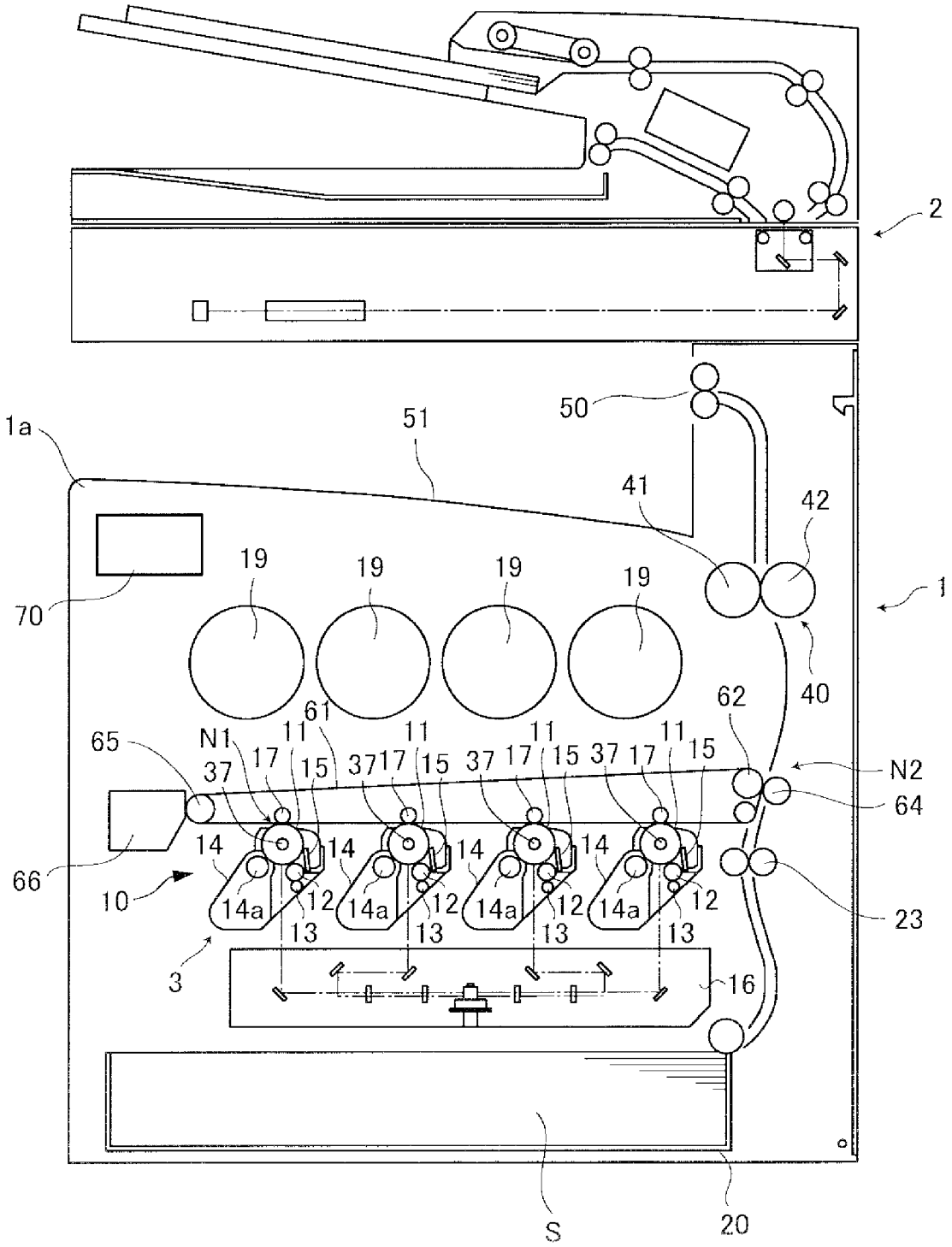
FIG. 1 is a section view illustrating a schematic configuration of an image forming apparatus according to a first embodiment of the present disclosure.

As illustrated in FIG. 1, the image forming apparatus 1 includes an apparatus body 1*a*, a sheet feed cassette 20, an image forming unit 10 and a control portion 70. The image forming apparatus 1 can form a four-color full-color image on the recording material corresponding to an image signal from a host device such as an image reading apparatus 2 and a personal computer or from an external device such as a digital camera and a smartphone.

The image forming apparatus 1 includes image forming units 10 of respective colors of Y (yellow), M (magenta), C (cyan) and K (black), which are arrayed in a rotation direction of an intermediate transfer belt 61. A configuration and an operation of each of the image forming units 10 is substantially the same except that colors of toners to be used are different. Therefore, the following description will be made by typically exemplifying the yellow image forming unit 10.

Figure 5:
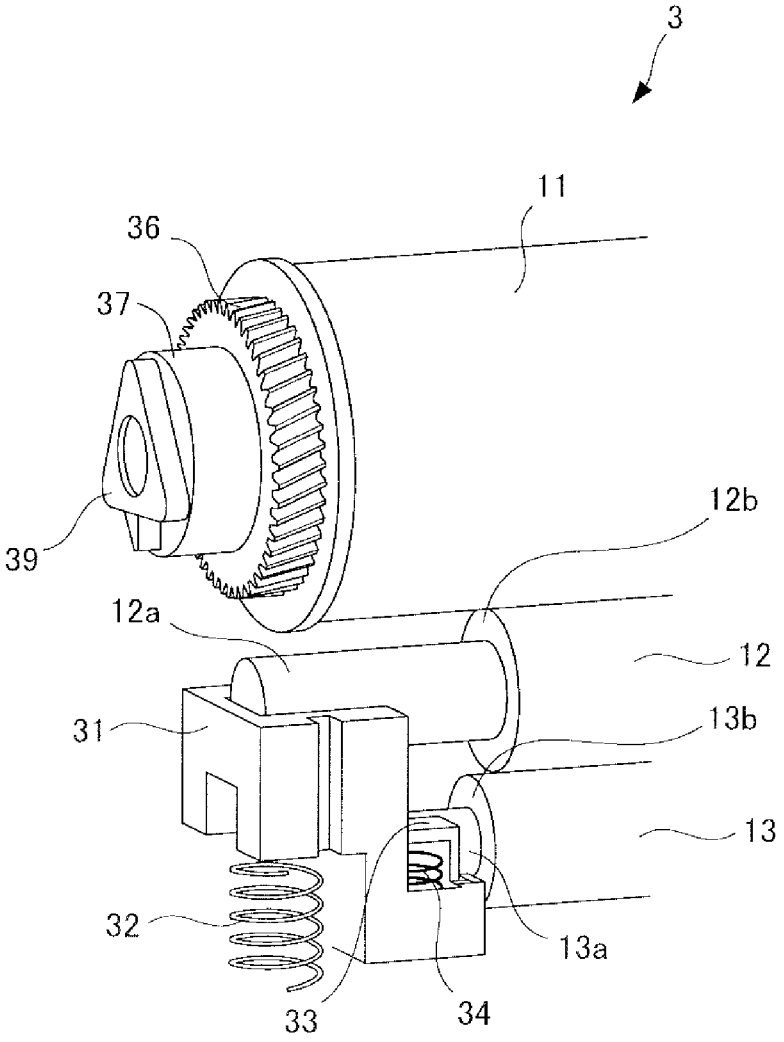
FIG. 5 is a partial perspective view schematically illustrating a configuration of the drum cartridge of the first embodiment while omitting a contacting/separating mechanism and a frame.

The image forming unit 10 includes a photosensitive drum 11 which is a cylindrical electrophotographic photosensitive member serving as a photosensitive member. The photosensitive drum 11 is rotationally driven with a process speed, i.e., a circumferential speed, of 100 to 300 mm/sec by a driving force transmitted from a driving motor 18 (see FIG. 2) provided in the apparatus body 1*a*. As illustrated in FIG. 5, both end portions in a rotation axial direction of the photosensitive drum 11 are supported by a rotation shaft 37 serving as a rotary member integrally rotating with the photosensitive drum 11. That is, the photosensitive drum 11 is coaxially provided on the rotation shaft 37. As illustrated in FIG. 3, the photosensitive drum 11 is configured to be able to rotate in an R1 direction, i.e., in a first direction, in forming an image by bearing an electrostatic image and in an R2 direction, i.e., in a second direction, opposite to the R1 direction.

As illustrated in FIG. 1, disposed around the photosensitive drum 11 in the image forming unit 10 sequentially along the rotation direction thereof are a charging roller 12, a developing unit 14, a primary transfer roller 17 and a drum cleaning unit 15. An exposing unit 16 is disposed under the respective image forming units 10. The image forming apparatus 1 also includes the intermediate transfer belt 61 formed of an endless belt member serving as an intermediate transfer member so as to come into contact with the photosensitive drum 11 of each image forming unit 10.

The charging roller 12 is a rotatable roller-like charging member and is disposed so as to come into contact with the photosensitive drum 11 to charge a surface of the photosensitive drum 11. The exposing unit 16 is a laser scanner unit and exposes the surface of the charged photosensitive drum 11 to form an electrostatic image on the surface of the photosensitive drum 11.

The developing unit 14 stores toner serving as developer therein and develops the electrostatic image formed on the photosensitive drum 11 as a toner image by using the toner. Such developing unit 14 includes a developing sleeve 14*a* serving as a developer bearing member capable of conveying the toner to a developing area facing the photosensitive drum 11 by rotating and moving while bearing the toner. The developing sleeve 14*a* is rotationally driven.

The primary transfer roller 17 is a roller-like primary transfer member and primarily transfers the toner image formed on the photosensitive drum 11 onto the intermediate transfer belt 61. The drum cleaning unit 15 is configured to clean transfer residual toner and others left on the photosensitive drum 11 after the primary transfer.

The intermediate transfer belt 61 is endlessly formed of dielectric resin such as polyimide. The intermediate transfer belt 61 is wrapped around a plurality of supporting rollers, i.e., stretch rollers, with a predetermined tension. Disposed at positions facing the respective photosensitive drums 11 on a side of an inner circumferential surface of the intermediate transfer belt 61 are the primary transfer rollers 17 described above. The primary transfer roller 17 is pressed against the photosensitive drum 11 through the intermediate transfer belt 61 and forms a primary transfer portion N1 where the intermediate transfer belt 61 is in contact with the photosensitive drum 11. The primary transfer roller 17 is driven along with the rotation of the intermediate transfer belt 61.

A secondary transfer roller 64 which is a roller-like secondary transfer member is also disposed at a position facing a secondary transfer roller counter roller 62 on a side of an outer circumferential surface, i.e., a surface side, of the intermediate transfer belt 61. The secondary transfer roller 64 is pressed against a secondary transfer counter roller 62 through the intermediate transfer belt 61 and forms a secondary transfer portion N2 where the intermediate transfer belt 61 is in contact with the secondary transfer roller 64. The toner image, which has been transferred onto the intermediate transfer belt 61, is secondarily transferred onto the sheet S at the secondary transfer portion N2.

A belt cleaning unit 66 is disposed at a position facing a tension roller 65 on a side of the outer circumferential surface of the intermediate transfer belt 61. The belt cleaning unit 66 cleans transfer residual toner left on the intermediate transfer belt 61 after the secondary transfer.

Figure 2:
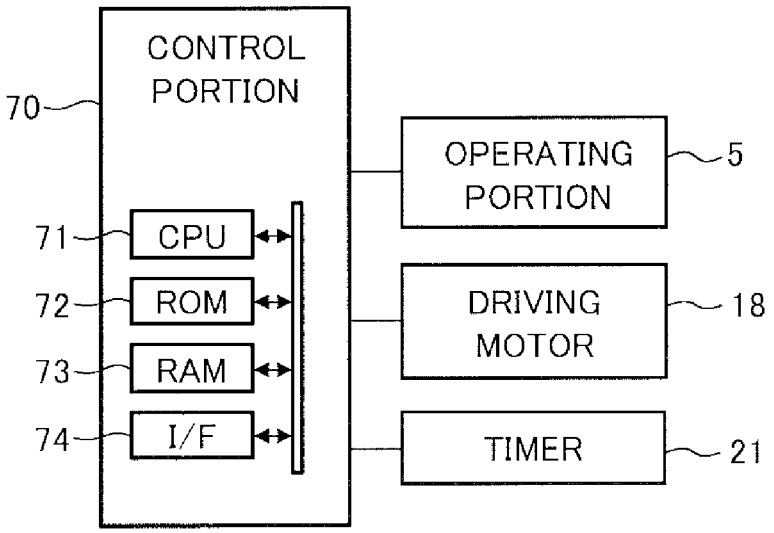
FIG. 2 is a block diagram illustrating a control system of the image forming apparatus of the first embodiment.
Figure 3:
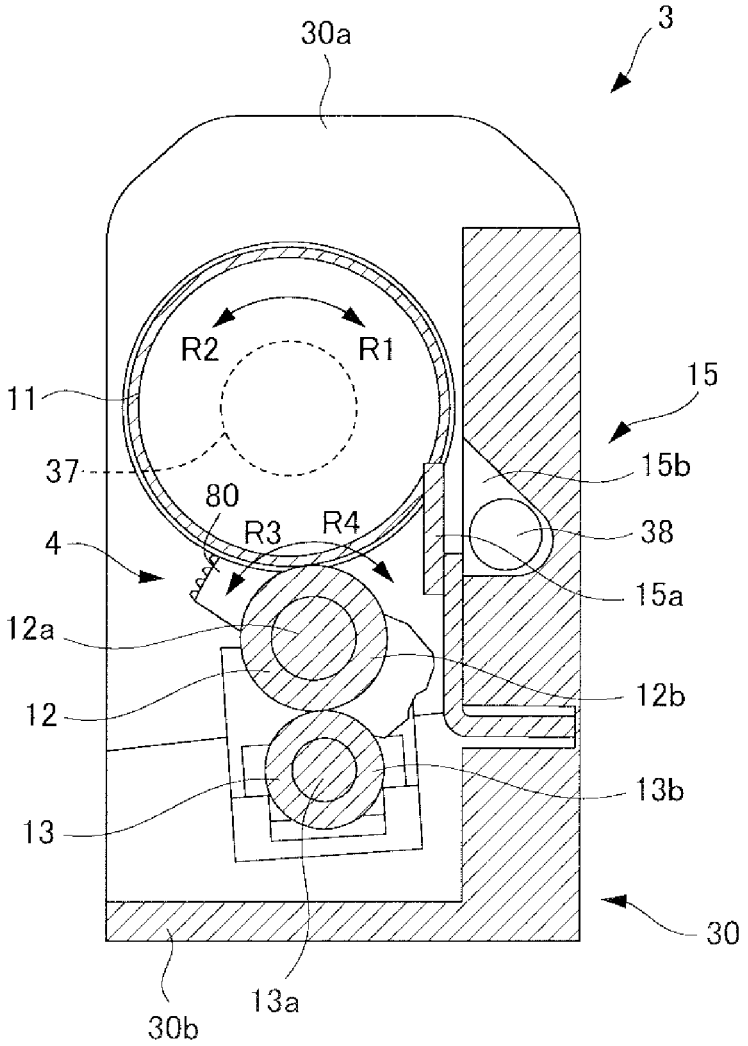
FIG. 3 is a section view schematically illustrating a configuration of a drum cartridge of the first embodiment.

As illustrated in FIG. 2, the control portion 70 is composed of a computer and includes a CPU 71, a ROM 72 storing programs that control respective portions, a RAM 73 temporarily storing data and an input/output circuit, i.e., I/F, 74. The CPU 71 is a microprocessor controlling the entire control of the image forming apparatus 1 and is a main body of a system controller. Set values necessary for various controls are recorded in the ROM 72 and are invoked by the CPU 71 as necessary. Various data such as a number of prints that varies depending on an image forming operation is temporarily recorded in the RAM 73 to be utilized in various controls.

The CPU 71 is connected with an operating portion 5, the driving motor 18, a timer 21 and others through the input/output circuit 74. The control portion 70 enables a user to operate and to set by commands from a computer knot illustrated) and connected with the apparatus body 1*a* or through operations made by the operating portion 5. The control portion 70 can control the rotation of the photosensitive drum 11 by controlling the driving motor 18. The timer 21 can measure a stop time of the photosensitive drum 11.

Next, an image forming operation will be described. The surface of the rotationally driven photosensitive drum 11 is homogeneously charged by the charging roller 12 with a predetermined potential of a predetermined polarity. According to the present embodiment, only DC voltage of −700 to 2000 V, e.g., −1300 V, is applied to the charging roller 12 from a charging high voltage power supply knot illustrated) to generate a discharge on the surface of the photosensitive drum 11 and to charge the surface of the photosensitive drum 11 at about −700 V.

After homogeneously charging the surface of the photosensitive drum 11, the surface of the photosensitive drum 11 is scanned and exposed by the exposing unit 16 based on signals of image information to form an electrostatic image on the photosensitive drum 11. Note that the image forming apparatus 1 of the present embodiment includes an image reading apparatus 2, and the abovementioned image information includes image information of a document read by the image reading apparatus 2 and image information sent from an external terminal such as a personal computer connected with the image forming apparatus 1.

The electrostatic image formed on the photosensitive drum 11 is developed as a toner image by the toner serving as developer by the developing unit 14. In the present embodiment, a normal charging polarity of the toner is negative. In developing the toner image, a developing bias, which is a predetermined voltage, is applied to the developing sleeve 14*a* from a high voltage power supply serving as a developing power supply knot illustrated). An oscillation voltage in which a DC voltage, i.e., a DC component, is superimposed with an AC voltage, i.e., an AC component, is used as a developing voltage. The toner is supplied to the developing unit 14 from a toner bottle 19 serving as a toner storage container through a toner conveyance path knot illustrated).

The toner image formed on the photosensitive drum 11 is primarily transferred onto the surface of the intermediate transfer belt 61 at the primary transfer portion N1 by an action of the primary transfer roller 17. At this time, the primary transfer bias of the DC voltage which is inverse to the charging polarity of the toner in development, i.e., positive in the present embodiment, is applied to the primary transfer roller 17 from a primary transfer power supply (not illustrated). The abovementioned operation is carried out in the respective image forming units 10 in forming a full-color toner image, and toner images of the respective colors of yellow, magenta, cyan and black formed on the respective photosensitive drums 11 are transferred onto the intermediate transfer belt 61 so as to be sequentially superimposed. After the transfer, transfer residual toner slightly left on the photosensitive drum 11 is removed by the drum cleaning unit 15 and is collected in a collecting portion.

Meantime, the sheet S is fed one by one from the sheet feed cassette 20 and is conveyed to a registration roller pair 23. After that, the registration roller pair 23 conveys the sheet S to a part between the intermediate transfer belt 61 and the secondary transfer roller 64 by synchronizing with the toner image on the intermediate transfer belt 61.

The color toner image on the intermediate transfer belt 61 is secondarily transferred onto a surface of the sheet S at the secondary transfer portion N2 by an action of the secondary transfer roller 64. When the sheet S passes through the secondary transfer portion N2, secondary transfer bias of DC voltage inverse to the charging polarity of the toner during the development is applied to the secondary transfer roller 64 from a secondary transfer power supply, i.e., a high voltage power supply (not illustrated). After the transfer, residual toner slightly left on the intermediate transfer belt 61 is removed and collected by the belt cleaning unit 66 to be ready for a next image forming process.

The toner image transferred onto the sheet S is fixed by being heated and pressurized at a nip portion between a heating roller 41 and a pressurizing roller 42 of a fixing unit 40, and then the sheet S is discharged onto a discharge tray 51 by a discharge roller pair 50.

Drum Cartridge

Next, a schematic configuration of the drum cartridge 3 serving as the photosensitive member unit will be described with reference to FIGS. 3 through 5. In a case of the present embodiment, the drum cartridge 3 including the photosensitive drum 11 is configured to be removably attached to the apparatus body 1*a* (see FIG. 1) to be able to replace for maintenance or the like. For instance, the drum cartridge 3 is removably attached to the apparatus body 1*a* by moving along a longitudinal direction, i.e., a rotation axial direction of the photosensitive drum 11.

Figure 4:
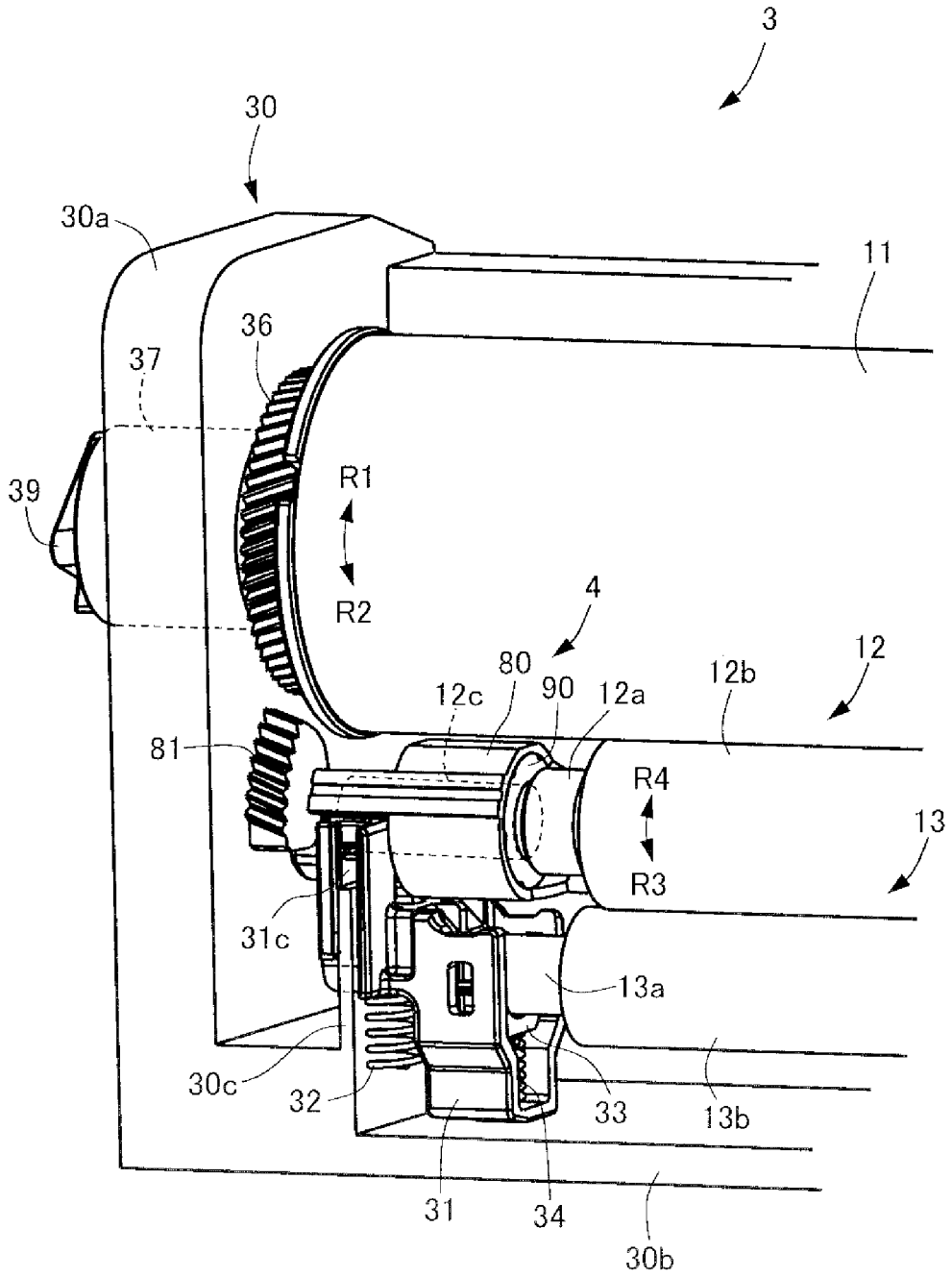
FIG. 4 is a partially perspective view schematically illustrating a configuration of the drum cartridge of the first embodiment.

As illustrated in FIGS. 3 through 5, the drum cartridge 3 includes the photosensitive drum 11 serving as the photosensitive member, the charging roller 12, a cleaning roller 13 serving as a cleaning member, a drum cleaning unit 15, a contacting/separating mechanism 4 and others. These component parts are integrally held in a drum container 30 serving as a frame.

The photosensitive drum 11 is held in the drum container 30 rotatably centering on a rotational axis through bearings knot illustrated). The drum container 30 includes side walls 30*a* disposed on both sides in the rotation axial direction of the photosensitive drum 11, the charging roller 12 and the cleaning roller 13 and a connecting portion 30*b* connecting the side walls 30*a* on both sides. Both side portions in the rotation axial direction of the photosensitive drum 11 are rotatably supported by the side walls 30*a* on both sides in the rotation axial direction through bearings.

Provided at a first end portion of the rotation shaft 37 of the photosensitive drum 11 is a coupling 39 that rotates by receiving a driving force from the driving motor 18 (see FIG. 2) provided in the apparatus body 1*a* in a state of being attached to the apparatus body 1*a* (see FIG. 1). The coupling 39 couples with a coupling provided on a side of the apparatus body 1*a* when the drum cartridge 3 is attached to the apparatus body 1*a* to transmit the driving force from the driving motor 18 provided in the apparatus body 1*a*.

The drum container 30 is also provided with the drum cleaning unit 15 as illustrated in FIG. 3. The drum cleaning unit 15 includes a cleaning blade 15*a*, a collecting portion 15*b* and a toner conveyance screw 38. The cleaning blade 15*a* is fixed to the drum container 30 and abuts with the surface of the photosensitive drum 11 in a counter direction with respect to the R1 direction, which is the normal direction, of the photosensitive drum 11 in forming an image to clean the surface of the photosensitive drum 11.

The collecting portion 15*b* is provided in a vicinity of the cleaning blade 15*a* to collect the transfer residual toner removed from the surface of the photosensitive drum 11 by the cleaning blade 15*a*. The toner conveyance screw 38 conveys the toner collected in the collecting portion 15*b* to outside of the drum cartridge 3. The toner conveyed by the toner conveyance screw 38 to the outside of the drum cartridge 3 is collected in a waste toner container (not illustrated) and provided in the apparatus body 1*a*.

As illustrated in FIGS. 4 and 5, a gear portion 36 serving as a first engagement portion or a first mesh portion is formed on an outer circumferential portion of the rotation shaft 37 of the photosensitive drum 11. The gear portion 36 is configured to rotate integrally with the photosensitive drum 11 on the rotation shaft 37 of the photosensitive drum 11. According to the present embodiment, the gear portion 36 is formed of a helical gear. The gear portion 36 rotates integrally with the photosensitive drum 11 as the driving force is inputted to the photosensitive drum 11 through the coupling 39. A turning force of the gear portion 36 is transmitted to the toner conveyance screw 38 (see FIG. 3). This arrangement makes it possible to rotate the toner conveyance screw 38 and to convey the transfer residual toner collected in the collecting portion 15*b* (see FIG. 3) to outside of the drum cartridge 3.

The charging roller 12 serving as a charging member is disposed under the photosensitive drum 11 and is a roller-like member including a rotation shaft 12*a* serving as a conductive supporting member, i.e., a core metal or a core, and an elastic layer 12*b* of one layer or more formed around the rotation shaft 12*a*. The charging roller 12 is brought into contact with the surface of the photosensitive drum 11 by a pressurizing spring 32 serving as an urging portion with a predetermined pressing force and is driven following the rotation of the photosensitive drum 11.

The charging roller 12 is rotatably supported by the rotation shaft 12*a* thereof that is held by a charging roller bearing 31. The charging roller bearing 31 is also supported slidably to the drum container 30. Specifically, the charging roller bearing 31 is configured to be slidably guided by a slide guide portion 30*c* provided in the drum container 30 in a direction heading toward the rotational axis of the photosensitive drum 11. In the illustrated example, a groove 31*c* is formed on the charging roller bearing 31 along the slide direction, and the charging roller bearing 31 is guided in the direction heading toward the rotational axis of the photosensitive drum 11 as the slide guide portion 30*c* engages with the groove 31*c*.

Then, the charging roller 12 supported by the charging roller bearing 31 is movable along the direction heading toward the rotational axis of the photosensitive drum 11 in a plane vertical to the rotational axis of the photosensitive drum 11. Thereby, the charging roller 12 is movable to a separate position Pb (see FIG. 9) where the charging roller 12 is separated from the surface of the photosensitive drum 11 and to a contact position Pa (see FIG. 6) where the charging roller 12 is in contact with the surface of the photosensitive drum 11. Then, in a case where the charging roller 12 is positioned at the contact position Pa, the charging roller 12 is driven by the photosensitive drum 11 and charges the surface of the photosensitive drum 11 by the voltage applied to the charging roller 12.

Still further, the pressurizing spring 32 is provided between the drum container 30 and the charging roller bearing 31. The pressurizing spring 32 is constituted of a compression coil spring, for example, and urges the charging roller 12 in the direction heading toward the rotational axis of the photosensitive drum 11, i.e., in an urging direction, in the plane vertical to the rotational axis of the photosensitive drum 11. That is, the pressurizing spring 32 urges the charging roller bearing 31 in the same direction as the slide direction of the charging roller bearing 31, i.e., in a direction heading toward the contact position Pa (see FIG. 6) from the separate position Pb (see FIG. 9) to urge the charging roller 12 to the photosensitive drum 11. To that end, the pressurizing spring 32 pushes up the charging roller bearing 31 to press an end portion of the rotation shaft 12*a* of the charging roller 12 upward and to form a nip portion N3 where the charging roller 12 is pressed against and in contact with the photosensitive drum 11.

As illustrated in FIG. 4, the contacting/separating mechanism 4 includes a separating member 80 and a one-way clutch 90 described later. The contacting/separating mechanism 4 enables the charging roller 12 to come into contact with the photosensitive drum 11 or to separate from the photosensitive drum 11 by positioning the charging roller 12 switchably to the contact position Pa (see FIG. 6) and to the separate position Pb (see FIG. 9). The contacting/separating mechanism 4 will be detailed later.

The cleaning roller 13 serving as the cleaning member is in contact with the charging roller 12 to clean the surface of the charging roller 12. The cleaning roller 13 includes a rotation shaft 13*a* which is a rod-like supporting portion, i.e., a core metal or a core, and an elastic layer 13*b* formed around the rotation shaft 13*a* and is a roller-like member in which an outer circumferential surface thereof is in contact with the charging roller 12. The cleaning roller 13 is brought in contact with the surface of the charging roller 12 by a pressurizing spring 34 with a predetermined pressing force and is driven following the rotation of the charging roller 12.

The cleaning roller 13 is supported rotatably by the rotation shaft 13*a* thereof that is supported by a cleaning roller bearing 33. The cleaning roller bearing 33 is also supported slidably to the charging roller bearing 31. The cleaning roller bearing 33 is configured to be slidable in a direction heading toward the rotational axis of the charging roller 12 such that the cleaning roller 13 is movable along a direction heading toward the rotational axis of the charging roller 12 in a plane vertical to the rotational axis of the charging roller 12. It is noted that the rotational axis of the charging roller 12 is common with a rotational axis of the separating member 80 described later in the present embodiment.

This arrangement makes it possible to provide the cleaning roller 13 to be movable to a roller contact position where the cleaning roller 13 comes into contact with the surface of the charging roller 12 and to a roller separate position where the cleaning roller 13 is separated from the surface of the charging roller 12. Then, the cleaning roller 13 cleans the charging roller 12 at the roller contact position.

The pressurizing spring 34 is provided between the charging roller bearing 31 and the cleaning roller bearing 33. The pressurizing spring 34 is constituted of a compression coil spring, for example, and urges the cleaning roller 13 in a direction, i.e., an urging direction, heading toward a rotation axial direction of the charging roller 12 in a plane vertical to a rotational axis of the charging roller 12. Due to that, the cleaning roller 13 is pressurized and comes into contact with the charging roller 12. That is, the pressurizing spring 34 urges the cleaning roller 13 in a direction heading to the roller contact position from the roller separate position. In other words, the cleaning roller 13 is supported by the cleaning roller bearing 33 so as to be movable along the urging direction urged by the pressurizing spring 34. Still further, the urging direction of the pressurizing spring 32 is approximately the same as the urging direction of the pressurizing spring 34 in the present embodiment.

The cleaning roller 13 is also supported by the charging roller bearing 31 through the cleaning roller bearing 33 and the pressurizing spring 34. Therefore, in a case where the charging roller 12 is moved in a direction of separating from the photosensitive drum 11 by the separating member 80 as described later, the cleaning roller 13 moves, in linkage with such movement, in the movement direction of the charging roller 12.

Due to the configuration as described above, when the photosensitive drum 11 rotates by receiving the driving force from a driving source such as the driving motor 18 (see FIG. 2) provided in the apparatus body 1*a*, the charging roller 12 is driven by friction with the photosensitive drum 11. When the charging roller 12 rotates, the cleaning roller 13 is also driven by friction with the charging roller 12. The toner conveyance screw 38 (see FIG. 3) also rotates by receiving a driving force, i.e., a turning force, from the gear portion 36.

Contacting/Separating Mechanism

Next, the contacting/separating mechanism 4 capable of contacting/separating the charging roller 12 with/from the photosensitive drum 11 will be described in detail with reference to FIGS. 4 through 6. Note that although FIG. 4 illustrates only a side of the first longitudinal end portion of the drum cartridge 3, a side of a second end of the drum cartridge 3 is symmetrically constructed. The contacting/separating mechanism 4 includes the separating member 80 provided around an outer circumferential portion of the rotation shaft 12*a* of the charging roller 12 and the one-way clutch 90 interposed between the rotation shaft 12*a* and the separating member 80 in a power transmission path.

As illustrated in FIG. 4, the rotation shaft 12*a* of the charging roller 12 is provided so as to project out of the elastic layer 12*b* in an axial direction. Formed at an end portion side of the part projecting out of the elastic layer 12*b* of the rotation shaft 12*a* in the axial direction is a small-diameter portion 12*c* in which an outer diameter thereof is reduced more than the other parts of the rotation shaft 12*a*. The small-diameter portion 12*c* is provided with the separating member 80 and the one-way clutch 90 coaxially with an axial center of the rotation shaft 12*a*. The rotation shaft 12*a* of the charging roller 12 is formed so as to project out in the axial direction further from the separating member 80 and edge portion thereof is rotatably supported by the charging roller bearing 31.

Figure 9:
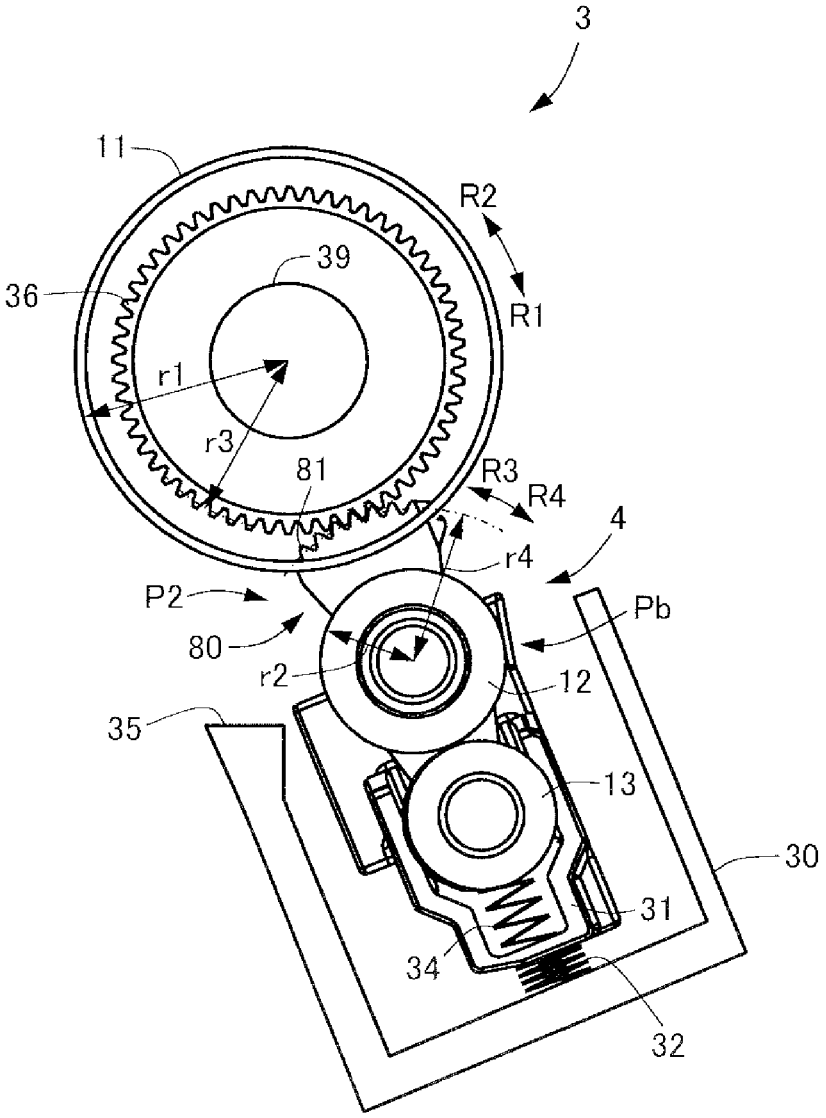
FIG. 9 is a section view illustrating a state in which the photosensitive drum of the drum cartridge of the first embodiment is separated from a charging roller by the separating member.

As illustrated in FIGS. 4 and 5, the separating member 80 includes a fan-shaped gear portion 81, serving as a second engagement portion or a second mesh portion, constituted of a helical gear engageable with, i.e., meshable with, the gear portion 36 formed around the rotation shaft 37 of the photosensitive drum 11. The separating member 80 is rotatably provided coaxially with the charging roller 12. That is, the gear portion 81 of the separating member 80 is provided to be engageable with the gear portion 36 of the photosensitive drum 11 from a lower side in terms of the direction of gravity. Still further, in a case where a radius of the photosensitive drum 11 is denoted as r1, a radius of the charging roller 12 as r2, a radius of a pitch circle of the gear portion 36 as r3 and a radius of a pitch circle of the gear portion 81 of the separating member 80 as r4 as illustrated in FIG. 9, they are set so as to satisfy a relationship of $r1+r2<r3+r4$. Accordingly, the photosensitive drum 11 and the charging roller 12 are inevitably separated when the gear portion 81 meshes with the gear portion 36.

The separating member 80 is provided to be rotatable or movable to a first position P1 (see FIG. 6) and to a second position P2 along the rotation of the charging roller 12. As illustrated in FIG. 6, the first position P1 of the separating member 80 is a position where the gear portion 81 is separated from the gear portion 36 and where the charging roller 12 is allowed to be positioned at the contact position Pa by being urged by the pressurizing spring 32. As illustrated in FIG. 9, the second position P2 of the separating member 80 is a position where the gear portion 81 engages with the gear portion 36 and where the charging roller 12 is positioned at the separate position Pb.

Figure 6:
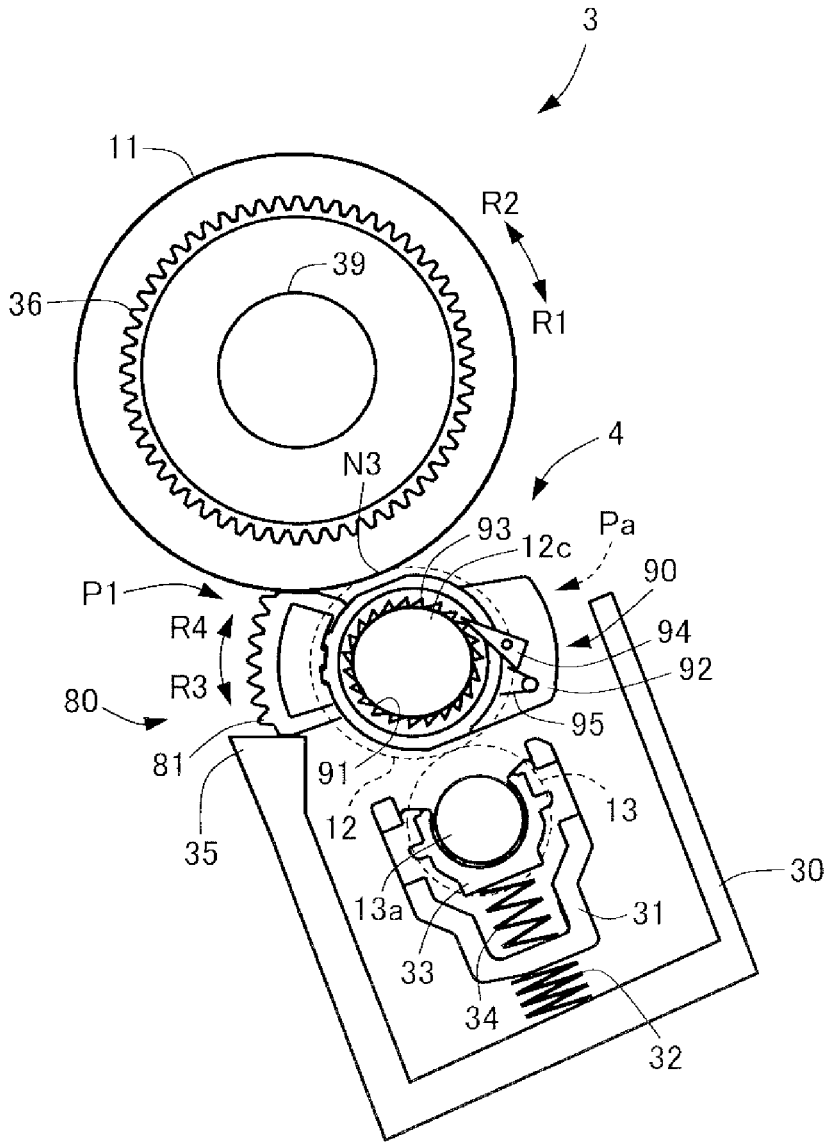
FIG. 6 is a section view illustrating a photosensitive drum of the drum cartridge of the first embodiment when the photosensitive drum rotates in a normal direction.

As illustrated in FIG. 6, the one-way clutch 90 includes an inner diametric portion 91 and an outer diametric portion 92 respectively having an approximately ringed shape. The inner diametric portion 91 serving as one example of a first cylindrical portion is provided with an inner circumferential surface fixed to an outer circumferential surface of the small-diameter portion 12*c* of the charging roller 12 and with a rack gear 93 formed on an outer circumferential surface thereof. The inner diametric portion 91 is rotatable integrally with the charging roller 12. The outer diametric portion 92 serving as one example of a second cylindrical portion is provided by being fixed to the separating member 80 at an outer circumferential side of the inner diametric portion 91 and includes a latch claw 94 engageable with the rack gear 93 and an urging spring 95 constituted of a torsion spring and urging the latch claw 94 toward the rack gear 93. The outer diametric portion 92 is provided concentrically with the inner diametric portion 91 and is rotatable integrally with the separating member 80. Each of teeth of the rack gear 93 includes a slope inclined from upstream to downstream in terms of an R3 direction so as to gradually approach to the center of rotation of the inner diametric portion 91 and a step forming a step by connecting an uppermost-stream end of a slope of one tooth with a downmost-stream end of a slope of another tooth adjacent to upstream of the one tooth. Note that because the outer diametric portion 92 of the one-way clutch 90 is fixed with the separating member 80, they always rotate integrally regardless of rotation directions. The rack gear 93, the latch claw 94 and the urging spring 95 constitute a latch mechanism. This latch mechanism transmits rotation of the inner diametric portion 91 to the outer diametric portion 92 in a case where the photosensitive drum 11 rotates in the R2 direction and idles the rotation of the inner diametric portion 91 with respect to the outer diametric portion 92 in a case where the photosensitive drum 11 rotates in the R1 direction.

In a case where the photosensitive drum 11 rotates in the R2 direction and the charging roller 12 rotates in an R4 direction, the step of the tooth of the rack gear 93 engages with a tip of the latch claw 94 in the one-way clutch 90. Therefore, the inner diametric portion 91 and the outer diametric portion 92 of the one-way clutch 90 are turned into a locked state in the R4 direction, and the charging roller 12 rotates integrally with the separating member 80. Meanwhile, in a case where the photosensitive drum 11 rotates in the R1 direction and the charging roller 12 rotates in the R3 direction, the tip of the latch claw 94 is guided slidably along the slope of the tooth of the rack gear 93 in the one-way clutch 90. Accordingly, the locked state of the inner diametric portion 91 and the outer diametric portion 92 of the one-way clutch 90 in the R4 direction is released, and the charging roller 12 idles with respect to the separating member 80. That is, in a case where the photosensitive drum 11 rotates in the R2 direction, the one-way clutch 90 transmits the rotation of the charging roller 12 to the separating member 80, and in a case where the photosensitive drum 11 rotates in the R1 direction, the one-way clutch 90 is configured to transmit rotation of the charging roller 12 to the separating member 80 or idle the charging roller 12 with respect to the separating member 80.

Note that in the present embodiment, in a case where a torque required for the separating member 80 to rotate is equal to or more than a predetermined idling torque when the photosensitive drum 11 rotates in the R1 direction, the one-way clutch 90 idles without transmitting the rotation of the charging roller 12 to the separating member 80. In contrary to that, in a case where a torque required for the separating member 80 to rotate is smaller than the predetermined idling torque, the one-way clutch 90 transmits the rotation of the charging roller 12 to the separating member 80. Still further, a regulating portion 35 is formed at a part of the drum container 30. In a case where the photosensitive drum 11 rotates in the R1 direction, the separating member 80 comes into contact with the regulating portion 35 at the first position P1 and is regulated from moving in the R3 direction beyond the first position P1. Note that an operation of the contacting/separating mechanism 4 will be detailed later. It is also noted that the one-way clutch 90 functions also as a torque limiting portion. That is, the torque limiting portion transmits a torque from the charging roller 12 to the separating member 80 in a case where the photosensitive drum 11 rotates in the R2 direction and limits the transmission of the torque from the charging roller 12 to the separating member 80 in a case where the photosensitive drum 11 rotates in the R1 direction.

While the case where the one-way clutch 90 includes the rack gear 93 and the latch claw 94 is being described in the present embodiment, the one-way clutch 90 is not limited to such configuration. The mechanism of the one-way clutch 90 is not specifically limited as long as the one-way clutch 90 turns into a locked state with a core metal when the one-way clutch 90 rotates in one direction with respect to the charging roller 12 and the one-way clutch 90 turns into an unlocked state when the one-way clutch 90 rotates in another direction. A configuration using a plurality of roller-like rotary members in contact with an outer circumference of the small-diameter portion 12*c* of the charging roller 12 is also applicable for example as the one-way clutch 90.

Operation of Contacting/Separating Mechanism

Next, an operation of separating the charging roller 12 from the photosensitive drum 11 will be described with reference to FIGS. 6 through 9. FIGS. 6 through 9 are section views in a direction vertical to the rotation axial direction of the photosensitive drum 11 of the drum cartridge 3.

As illustrated in FIG. 6, the separating member 80 is positioned at the first position P1 and the charging roller 12 is positioned at the contact position Pa normally in forming an image to execute an image forming operation as the photosensitive drum 11 rotates in the R1 direction as the normal direction. When the photosensitive drum 11 rotates normally in the R1 direction, the charging roller 12 being pressed against and in contact with the photosensitive drum 11 is driven in the R3 direction. When the charging roller 12 rotates in the R3 direction, the small-diameter portion 12*c* of the charging roller 12 also rotates in the R3 direction. When the small-diameter portion 12*c* of the charging roller 12 rotates in the R3 direction, the rack gear 93 of the inner diametric portion 91 of the one-way clutch 90 fixed to the small-diameter portion 12*c* of the charging roller 12 rotates in the R3 direction. At this time, the claw tip portion of the latch claw 94 is urged toward the rack gear 93 by an urging force of the urging spring 95. However, because the tip of the latch claw 94 is slidably guided along the slope of the tooth of the rack gear 93, the latch claw 94 does not mesh with the rack gear 93 and is unable to rotate the separating member 80 in the R3 direction.

At this time, in a case where the torque required for the separating member 80 to rotate in the R3 direction is smaller than a predetermined idling torque, the one-way clutch 90 transmits rotation of the charging roller 12 to the separating member 80. However, because the separating member 80 is in contact with the regulating portion 35 in the R3 direction, the separating member 80 is turned into a state of being regulated at the first position P1 and the separating member 80 cannot be rotated in the R3 direction more than that. Then, the torque required for the separating member 80 to rotate in the R3 direction increases to equal to or more than the predetermined idling torque. Therefore, the one-way clutch 90 idles without transmitting the rotation of the charging roller 12 to the separating member 80, and the charging roller 12 is turned into a rotation state while stopping the separating member 80. The gear portion 81 of the separating member 80 also does not contact with the gear portion 36 of the photosensitive drum 11 and is left in a state of being separated.

Figure 7:
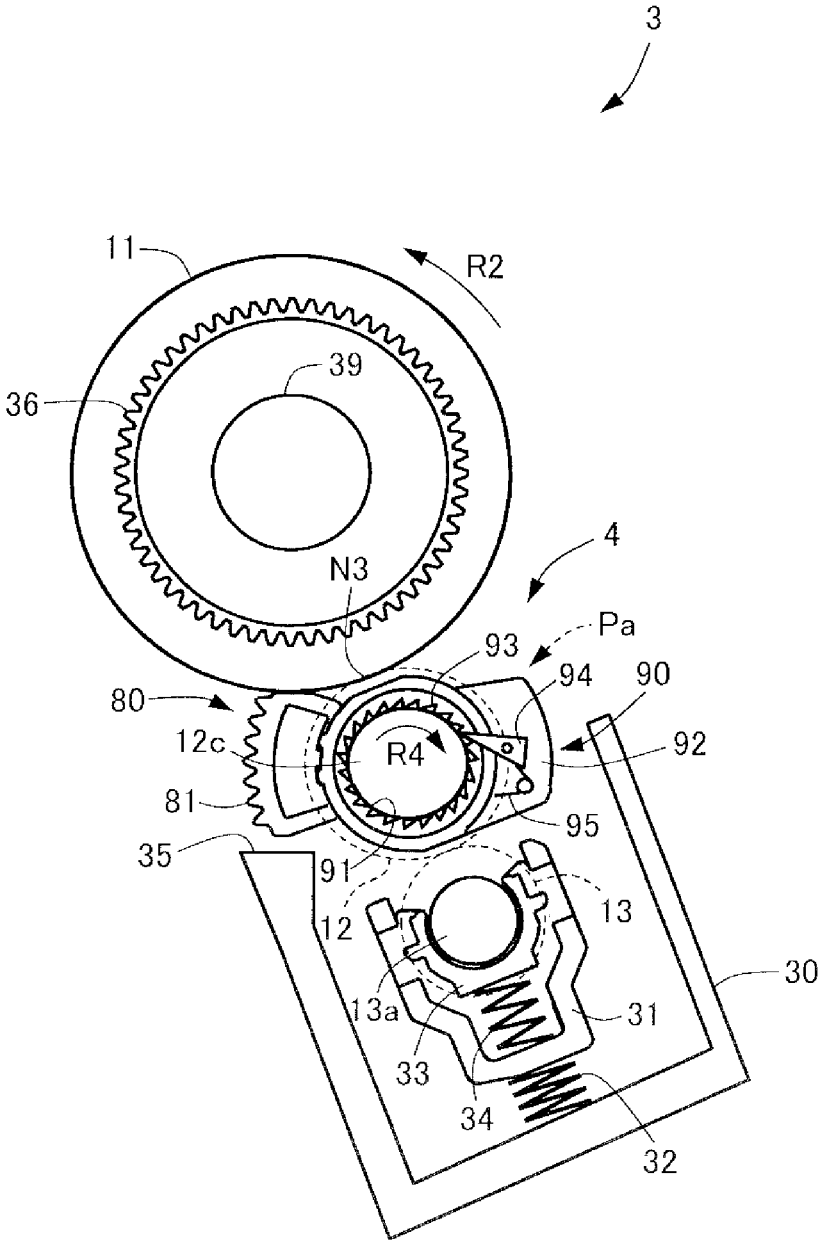
FIG. 7 is a section view illustrating a state before a gear portion of a separating member comes into contact with a gear portion of the photosensitive drum when the photosensitive drum of the drum cartridge of the first embodiment rotates in a reverse direction.

Next, if the photosensitive drum 11 is rotated reversely in the R2 direction as illustrated in FIG. 7, the charging roller 12 being pressed against and in contact with the surface of the photosensitive drum 11 is driven by the photosensitive drum 11 and rotates in the R4 direction while positioning at the contact position Pa. When the small-diameter portion 12*c* of the charging roller 12 rotates in the R4 direction, the rack gear 93 rotates in the R4 direction. The latch claw 94 is urged toward the rack gear 93 by the urging spring 95 and engages with the rack gear 93 as the tip engages with the step. A turning force of the rack gear 93 is transmitted to the separating member 80 via the latch claw 94, so that the separating member 80 separates from the regulating portion 35 of the drum container 30 and starts to rotate in the R4 direction from the first position P1 (see FIG. 6).

Figure 8:
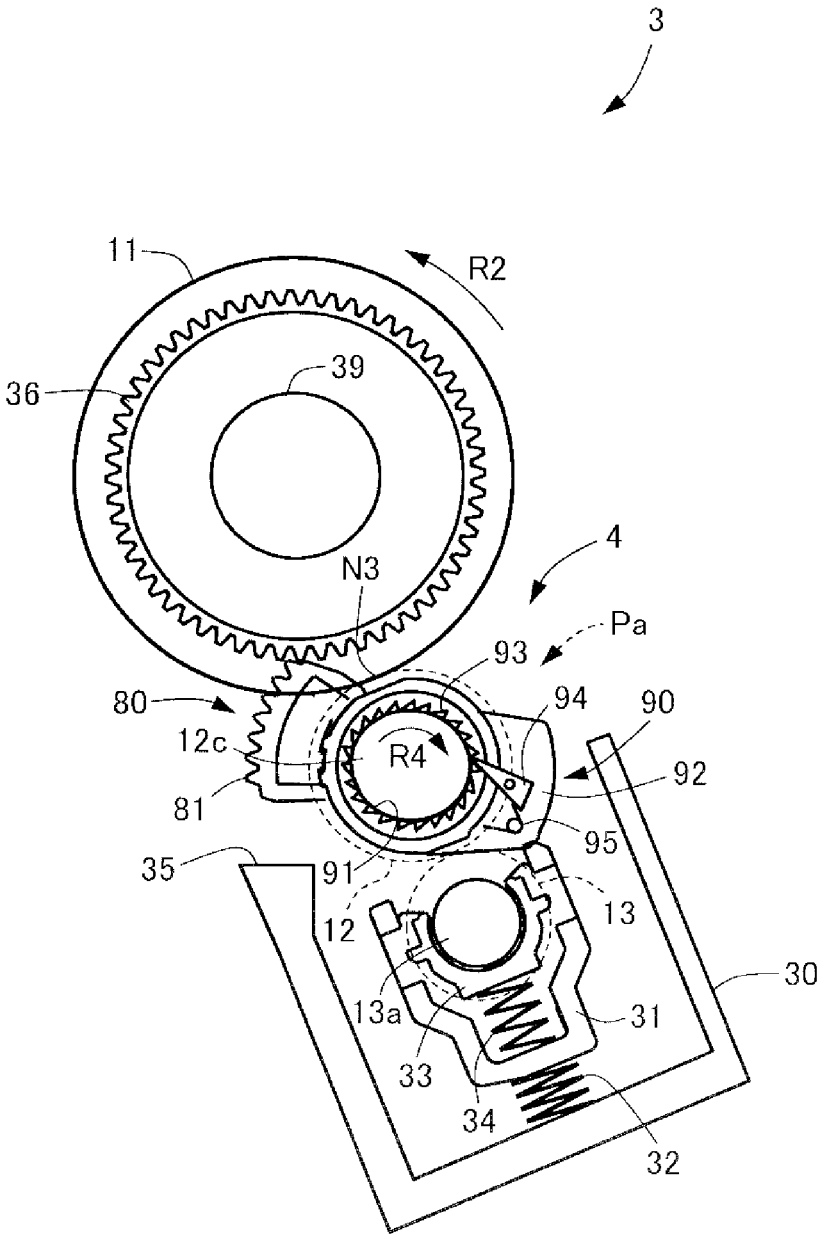
FIG. 8 is a section view illustrating a state in which the gear portion of the separating member starts to mesh with the gear portion of the photosensitive drum when the photosensitive drum of the drum cartridge of the first embodiment rotates in the reverse direction.

Then, as the separating member 80 rotates further in the R4 direction as illustrated in FIG. 8, the gear portion 81 of the separating member 80 comes into contact with the gear portion 36 provided in the photosensitive drum 11 and the gears of both gear portions start to mesh with each other. As the gear portion 81 meshes with the gear portion 36, the separating member 80 moves the charging roller 12 in a direction of separating from the photosensitive drum 11 and moves the charging roller 12 toward the separate position Pb (see FIG. 9) from the contact position Pa. Thereby, the photosensitive drum 11 rotates in the R2 direction and the photosensitive drum 11 and the charging roller 12 are turned into a state in which they do not contact with each other in operations at the time of and after the gear portion 81 of the separating member 80 meshes with the gear portion 36 of the photosensitive drum 11. Accordingly, a turning force transmission path from the photosensitive drum 11 to the separating member 80 through the small-diameter portion 12*c* of the charging roller 12 is cut off. Meanwhile, because the gear portion 81 of the separating member 80 directly meshes with the gear portion 36 and the turning force is directly transmitted from the photosensitive drum 11 to the separating member 80, the separating member 80 continues to rotate in the R4 direction.

After that, because the control portion 70 (see FIG. 2) stops the rotation of the photosensitive drum 11 in the R2 direction at a predetermined rotation angle, the photosensitive drum 11 stops in a state in which the gear portion 36 of the photosensitive drum 11 is meshed with the gear portion 81 of the separating member 80 as illustrated in FIG. 9. At this time, the separating member 80 coaxially provided around the small-diameter portion 12*c* of the charging roller 12 is pressed down by resisting against the pressurizing spring 32 to position the separating member 80 at the second position P2 and to position the charging roller 12 at the separate position Pb. Thereby, the charging roller 12 and the photosensitive drum 11 are held in a separated state. That is, in a case where the photosensitive drum 11 rotates in the R2 direction when the separating member 80 is positioned at the first position P1 (see FIG. 6), the one-way clutch 90 transmits the rotation of the driven charging roller 12 to the separating member 80. Then, along with the movement of the separating member 80 to the second position P2, the gear portion 81 engages with the gear portion 36 and positions the charging roller 12 to the separate position Pb.

Next, in a case where the charging roller 12 is to be moved from the separate position Pb to the contact position Pa (see FIG. 6), the photosensitive drum 11 is rotated in the R1 direction. Because the gear portion 36 of the photosensitive drum 11 is meshing with the gear portion 81 of the separating member 80, the separating member 80 rotates in the R3 direction from the second position P2 by rotating the photosensitive drum 11 in the R1 direction. Then, as the engagement of the gear portion 36 of the photosensitive drum 11 with the gear portion 81 of the separating member 80 is released as illustrated in FIG. 8, the separating member 80 recedes from the gap between the charging roller 12 and the photosensitive drum 11, and the charging roller 12 comes into contact with the photosensitive drum 11 by an urging force of the pressurizing spring 32. That is, the charging roller 12 moves from the separate position Pb (see FIG. 9) to the contact position Pa.

Here, if the photosensitive drum 11 rotates further normally in the R1 direction, the charging roller 12 pressed against and in contact with the photosensitive drum 11 is driven in the R3 direction and the rack gear 93 of the inner diametric portion 91 of the one-way clutch 90 rotates in the R3 direction. At this time, the latch claw 94 does not mesh with the rack gear 93 and is unable to rotate the separating member 80 in the R3 direction. However, because the separating member 80 is not in contact with the regulating portion 35, the separating member 80 can rotate in the R3 direction with a torque smaller than the predetermined idling torque. Due to that, because a torque required by the separating member 80 to rotate in the R3 direction is smaller than the predetermined idling torque, the one-way clutch 90 transmits the rotation of the charging roller 12 to the separating member 80 and rotates the separating member 80 in the R3 direction. After that, as illustrated in FIG. 6, as the separating member 80 reaches and comes into contact with the regulating portion 35 in the R3 direction, the separating member 80 is turned into a state of being regulated at the first position P1. Thereby, the separating member 80 cannot be rotated more than that in the R3 direction, the torque required by the separating member 80 to rotate in the R3 direction increases equal to or more than the predetermined idling torque and the one-way clutch 90 idles without transmitting the rotation of the charging roller 12 to the separating member 80. That is, in a case where the photosensitive drum 11 rotates in the R1 direction when the separating member 80 is positioned at the second position P2 (see FIG. 9), the rotation of the gear portion 36 is transmitted from the gear portion 81 to the separating member 80. Then, along with the movement of the separating member 80 to the first position P1, the gear portion 81 is separated from the gear portion 36 and the charging roller 12 is positioned at the contact position Pa.

Figure 10:
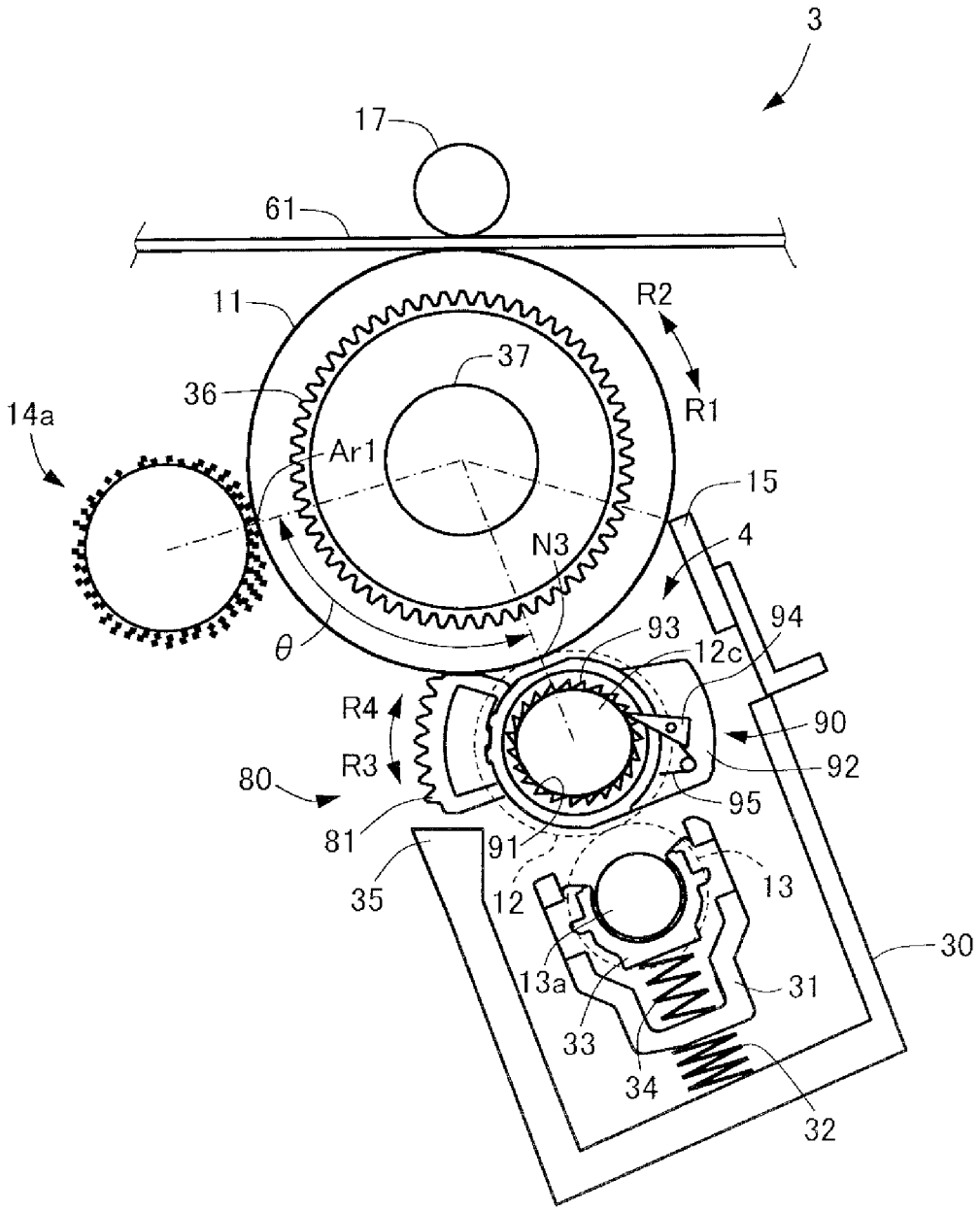
FIG. 10 is a section view illustrating a positional relationship between the drum cartridge of the first embodiment and its surrounding components.

Next, a rotation amount when the photosensitive drum 11 rotates in the R2 direction will be described with reference to FIG. 10. The developing sleeve 14*a* provided within the developing unit 14 is disposed so as to face a developing area Ar1 of the photosensitive drum 11 while keeping a predetermined distance. At this time, an angle formed centering on the center of rotation of the photosensitive drum 11 between the nip portion N3 between the charging roller 12 and the photosensitive drum 11 and the developing area Ar1 is set as θ. Then, numbers of teeth of the gear portion 81 of the separating member 80 and the gear portion 36, modules and the position of the regulating portion 35 are set respectively such that the rotation angle of the photosensitive drum 11 in the R2 direction for separating the charging roller 12 is under θ. Here, a length of the surface of the photosensitive drum 11 from the developing area Ar1 on the photosensitive drum 11 to the nip portion N3 where the photosensitive drum 11 is in contact with the charging roller 12 is denoted as L1. Then, a length of a moving locus of a part located at the developing area Ar1 of the photosensitive drum 11 when the separating member 80 moves from the first position P1 (see FIG. 6) to the second position P2 (see FIG. 9) is denoted as L2. Here, an arrangement of components is set so as to meet a relationship of L1>L2. This arrangement makes it possible to prevent the developer that has adhered at the developing area Ar1 on the surface of the photosensitive drum 11 from arriving at the nip portion N3 between the photosensitive drum 11 and the charging roller 12 when the photosensitive drum 11 rotates in the R2 direction. Therefore, it is possible to restrain the charging roller 12 from being contaminated by the toner.

According to the present embodiment, the contacting/separating mechanisms 4 are provided at both end portions in the rotation axial direction of the charging roller 12. Then, the positions of the regulating portion 35 are matched between the two contacting/separating mechanisms 4 to match rotation angles and phases of the photosensitive drum 11 when the separating member 80 is moved from the first position P1 (see FIG. 6) to the second position P2 (see FIG. 9). This arrangement makes it possible to equalize times taken from when the separating members 80 at both end portions in the rotation axial direction are separated from the regulating portions 35 until the gear portion 81 comes into contact with the gear portion 36 and to improve accuracy of the rotation amount in the R2 direction of the photosensitive drum 11.

Figure 11:
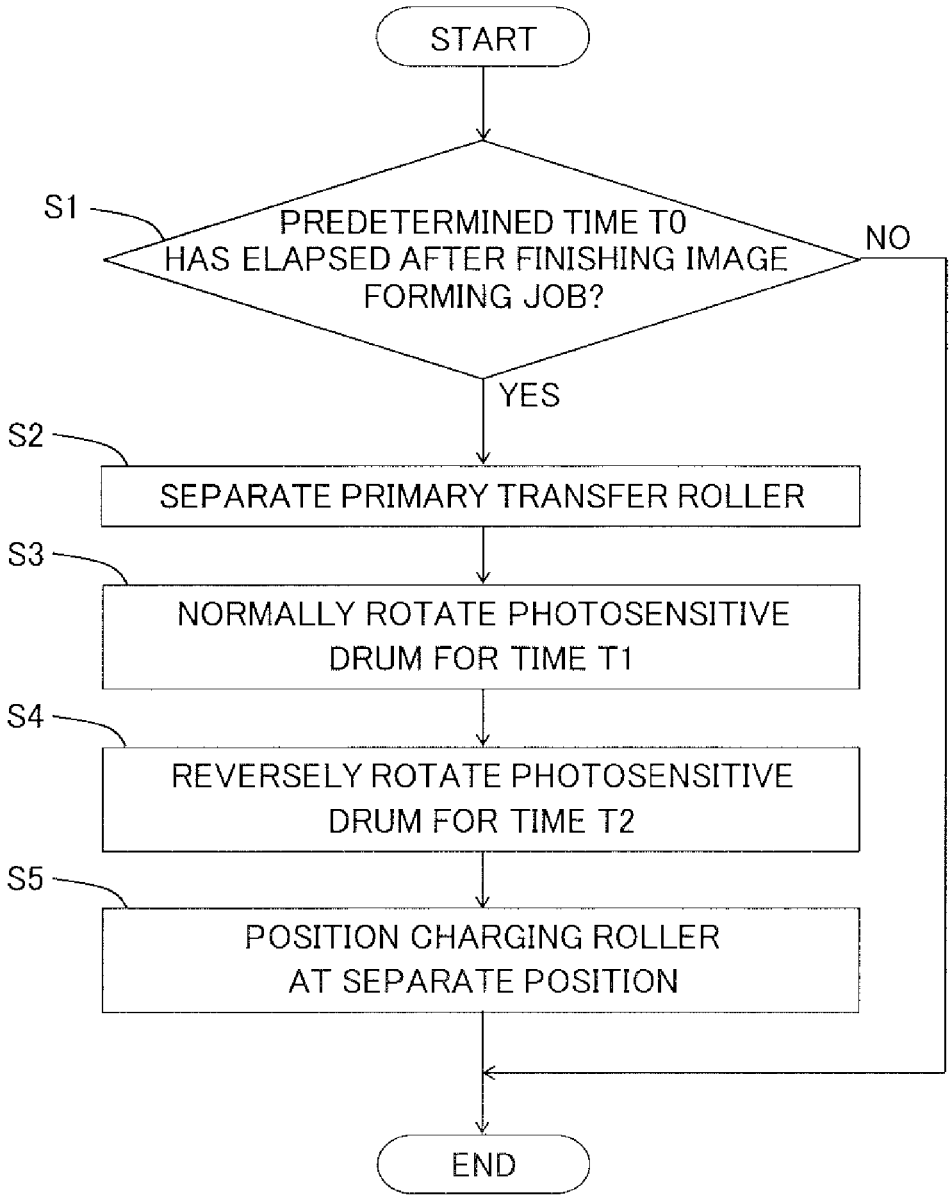
FIG. 11 is a flowchart illustrating operational procedures of the contacting/separating mechanism after an image forming job has been finished in the image forming apparatus of the first embodiment.
Figure 12:
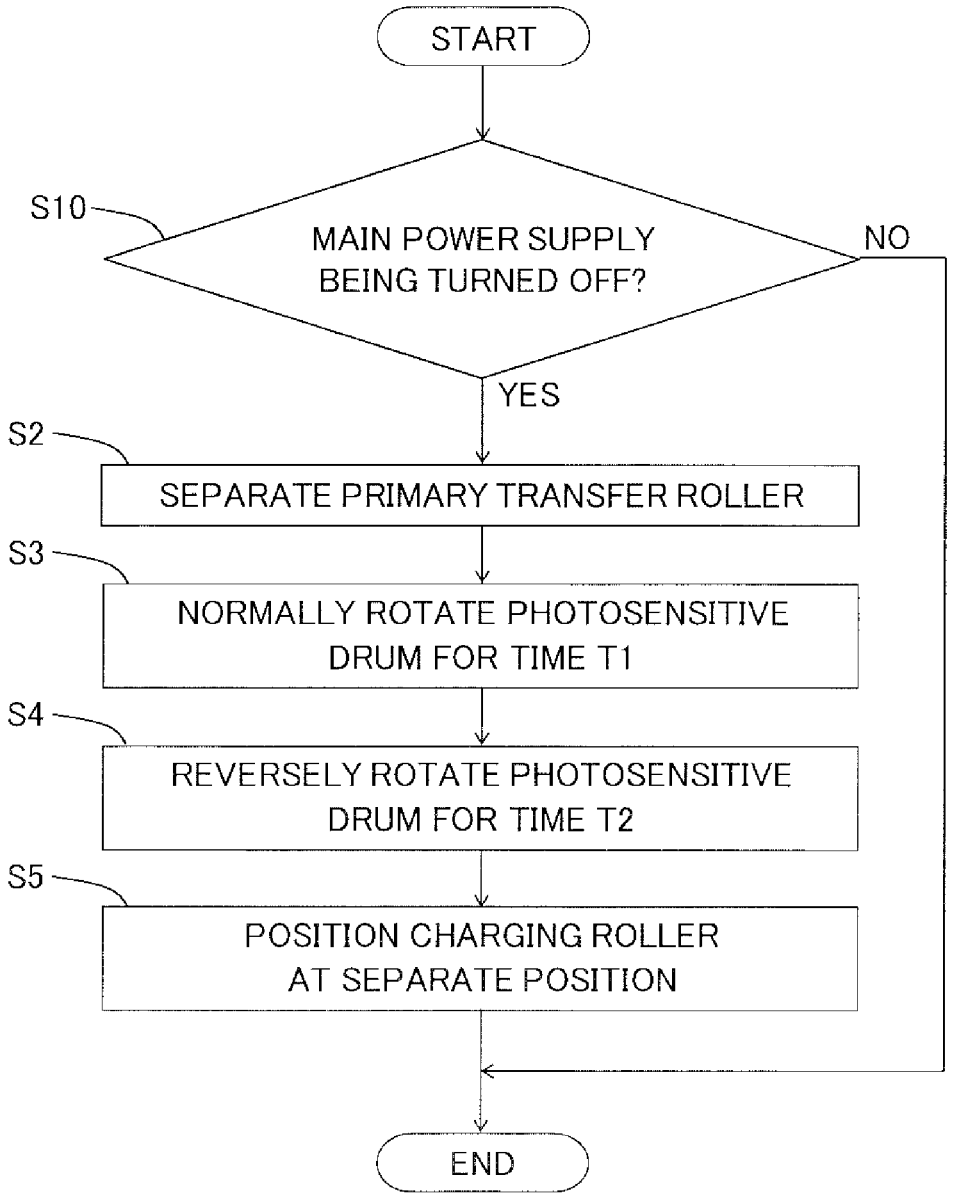
FIG. 12 is a flowchart illustrating operational procedures of the contacting/separating mechanism after a main power supply has been turned off in the image forming apparatus of the first embodiment.

Next, operational procedures in separating the charging roller 12 from the photosensitive drum 11 by rotating the photosensitive drum 11 in the R2 direction in the image forming apparatus 1 of the present embodiment will be described with reference to flowcharts illustrated in FIGS. 11 and 12. Here, if the charging roller 12 is continuously in pressure contact with the photosensitive drum 11 at a same location for a long period of time, there is a possibility that the charging roller 12 is deformed, thus causing image defects in a case where an image forming operation is executed after that. Then, in the present embodiment, cases where an image forming job is finished and where main power supply is turned off will be exemplified respectively as cases where the charging roller 12 is possibly continuously in pressure contact with the photosensitive drum 11 at the same location for a long period of time. Note that both cases where the image forming job is finished and where the main power supply is turned off are executed in the present embodiment, but the present embodiment is not limited to that and either one may be executed.

At first, an operational procedure in a case where a predetermined time T0 has elapsed after finishing the image forming job will be described with reference to the flowchart in FIG. 11. After finishing the image forming job, the control portion 70 judges whether the predetermined time T0 has elapsed by utilizing a timer 21 in Step S1. Or, the control portion 70 judges whether the predetermined time T0 has elapsed in the same manner even if the photosensitive drum 11 stops for some reason during the image forming job. The predetermined time T0 here may be four hours, for example. However, the predetermined time T0 is not limited to four hours and may be appropriately set as three hours or as five hours. In a case where the control portion 70 judges that the predetermined time T0 has not elapsed yet, i.e., NO in Step S1, the control portion 70 finishes the process. In a case where the control portion 70 judges that the predetermined time T0 has elapsed, i.e., YES in Step S1, the control portion 70 separates the primary transfer roller 17 from the photosensitive drum 11 in Step S2.

Then, the control portion 70 rotationally drives the driving motor 18 in the normal direction to rotate the photosensitive drum 11 in the R1 direction, i.e., in the normal direction, for a first time T1 in Step S3. Here, the first time T1 is set to be enough time for the separating member 80 to arrive at the first position P1, even if the separating member 80 is positioned at any place and may be 120 ms, for example. Thereby, the separating member 80 is positioned at the first position P1 and the charging roller 12 is positioned at the contact position Pa where the charging roller 12 is in contact with the photosensitive drum 11 (see FIG. 6).

Next, the control portion 70 rotationally drives the driving motor 18 in the reverse direction to rotate the photosensitive drum 11 in the R2 direction, i.e., in the reverse direction, for a second time T2 in Step S4. The second time T2 is a time taken for the separating member 80 to move from the first position P1 until stopping at the second position P2 and may be 100 ms for example. Note that while the second time T2 is set to be 100 ms here, it is not limited to such time and may be a time set in advance by which the separating member 80 can be stopped at the second position P2. Still further, the second time T2 is set such that the rotation angle of the separating member 80 is an angle not greater than the angle θ centering on the center of rotation of the photosensitive drum 11 between the nip portion N3 and the developing area Ar1. Thereby, the separating member 80 is positioned at the second position P2 and the charging roller 12 is positioned at the separate position Pb where the charging roller 12 is separated from the photosensitive drum 11 in Step S5 (see FIG. 9).

While the first time T1 is set to be longer than the second time T2 in the present embodiment, the present embodiment is not limited to that and the first time T1 may be equal to the second time T2. In this case, because the second time T2 is determined based on a time during which the separating member 80 moves from the first position P1 to the second position P2, the first time T1 is matched with the second time T2. Still further, while the photosensitive drum 11 is rotated in the R1 direction before rotating in the R2 direction in the present embodiment, the present embodiment is not limited to that. For instance, because the photosensitive drum 11 is rotated in the R1 direction in forming an image, the photosensitive drum 11 may be rotated in the R2 direction without rotating in the R1 direction after an elapse of the predetermined time T0.

Next, operational procedures in a case where the main power supply of the image forming apparatus 1 is turned off will be described with reference to the flowchart in FIG. 12. The control portion 70 judges whether the main power supply of the image forming apparatus 1 has been turned off in Step S10. Here, because it is unable to judge the elapse of the predetermined time T0 after the case where the main power supply has been turned off, the judgement is triggered by a fact that the main power supply is put into a turned-off state. In a case where the control portion 70 judges that the main power supply is not being turned off, i.e., NO in Step S10, the control portion 70 finishes the process. In a case where the control portion 70 judges that the main power supply has been turned off, i.e., YES in Step S10, the control portion 70 separates the primary transfer roller 17 from the photosensitive drum 11 in Step S2. Because the operational procedures after that are the same with those illustrated in the flowchart in FIG. 11, they are denoted by the same reference numerals and their detailed description will be omitted here.

That is, the control portion 70 can execute the following controls after the elapse of the predetermined time T0 after stopping the rotation of the photosensitive drum 11 or after the main power supply has been turned off. That is, the control portion 70 rotates the photosensitive drum 11 in the R1 direction for the first time T1 to position the separating member 80 at the first position P1 and rotates the photosensitive drum 11 in the R2 direction for the second time T2 to position the separating member 80 at the second position P2. Therefore, because the photosensitive drum 11 is rotated in the R1 direction before the photosensitive drum 11 is rotated in the R2 direction, positioning of the separating member 80 to the first position P1 and phase matching of the rotation can be steadily made and the operation of positioning the separating member 80 to the second position P2 after that can be executed in high precision.

As described above, according to the drum cartridge 3 of the present embodiment, the contacting/separating mechanism 4 is capable of idling the charging roller 12 without transmitting the rotation of the charging roller 12 to the separating member 80 by positioning the separating member 80 at the first position P1 in a case where the photosensitive drum 11 rotates in the R1 direction. Still further, in a case where the separating member 80 is positioned at the first position P1, the gear portion 81 is separated from the gear portion 36. Therefore, while it is possible to switch the contact/separation of the photosensitive drum 11 and the charging roller 12 by the separating member 80, it is possible to restrain the vibration of the photosensitive drum 11 otherwise caused by the separating member 80 being in contact with the gear portion 36 of the photosensitive drum 11 in forming an image.

Still further, according to the drum cartridge 3 of the present embodiment, in a case where the radius of the photosensitive drum 11 is denoted as r1, the radius of the charging roller 12 as r2, the radius of the pitch circle of the gear portion 36 as r3 and the radius of the pitch circle of the gear portion 81 of the separating member 80 as r4, the relationship of $r1+r2<r3+r4$ is met. Therefore, the charging roller 12 can be steadily separated from the photosensitive drum 11 by meshing the gear portion 81 with the gear portion 36.

Still further, according to the drum cartridge 3 of the present embodiment, in a case where the torque required by the separating member 80 to rotate is smaller than a predetermined idling torque, the one-way clutch 90 transmits the rotation of the charging roller 12 to the separating member 80. Thereby, because the torque required for the separating member 80 to rotate in the R3 direction when the separating member 80 moves from the second position P2 to the first position P1 is smaller than the predetermined idling torque, the one-way clutch 90 transmits the rotation of the charging roller 12 to the separating member 80 and rotates the separating member 80. Therefore, because the separating member 80 separates steadily from the photosensitive drum 11, it is possible to restrain the vibration of the photosensitive drum 11 otherwise caused by the separating member 80 being in contact with the gear portion 36 of the photosensitive drum 11 in forming an image.

Still further, according to the drum cartridge 3 of the present embodiment, the regulating portion 35 regulates the separating member 80 from moving in the R3 direction beyond the first position P1. Therefore, the first position P1 of the separating member 80 is mechanically determined at a fixed position. This arrangement makes it possible to stabilize the rotation angle and the phase of the photosensitive drum 11 until the separating member 80 moves from the first position P1 to the second position P2 and to improve accuracy in positioning the separating member 80 at the second position P2.

Note that while the case in which the present embodiment is applied to the photosensitive drum 11 as one example of the photosensitive member has been described in the drum cartridge 3 of the present embodiment described above, the present embodiment is not limited to that. For instance, the present embodiment is applicable to a photosensitive belt as the photosensitive member, and in such a case, the gear portion 36 is provided in a rotary roller nipping the photosensitive belt between the charging roller 12 and the rotary roller. Then, it is possible to restrain the vibration of the photosensitive belt by arranging such that the gear portion 81 of the separating member 80 does not come into contact with the gear portion 36 in a case where the photosensitive belt rotates in the R1 direction.

Still further, while the case where the separating member 80 is rotatably provided coaxially with the charging roller 12 has been described in the drum cartridge 3 of the present embodiment described above, the present embodiment is not limited to that. For instance, the separating member may be a member having a straight shape along a tangential line of the nip portion N3 between the photosensitive drum 11 and the charging roller 12 and being capable of reciprocating along the tangential line of the nip portion N3. In this case, a gear portion capable of meshing with the gear portion 36 is provided at a side portion on a side facing the gear portion 36 of the separating member, and the one-way clutch 90 is interposed between the separating member and the charging roller 12. Then, in a case where the photosensitive drum 11 rotates in the R1 direction, the charging roller 12 is made to idle without transmitting the rotation of the charging roller 12 to the separating member. This arrangement makes it possible to restrain the vibration of the photosensitive drum 11 otherwise caused by the contact of the separating member with the gear portion 36 of the photosensitive drum 11 in forming an image.

Second Embodiment

Next, a second embodiment of the present disclosure will be described in detail with reference to FIG. 13. The present embodiment is different from the configuration of the first embodiment in that a charging roller 12 is disposed above a photosensitive drum 11. However, the configuration of the present embodiment is otherwise the same with that of the first embodiment, the respective components will be denoted by the same reference numerals and their detailed description will be omitted.

Figure 13:
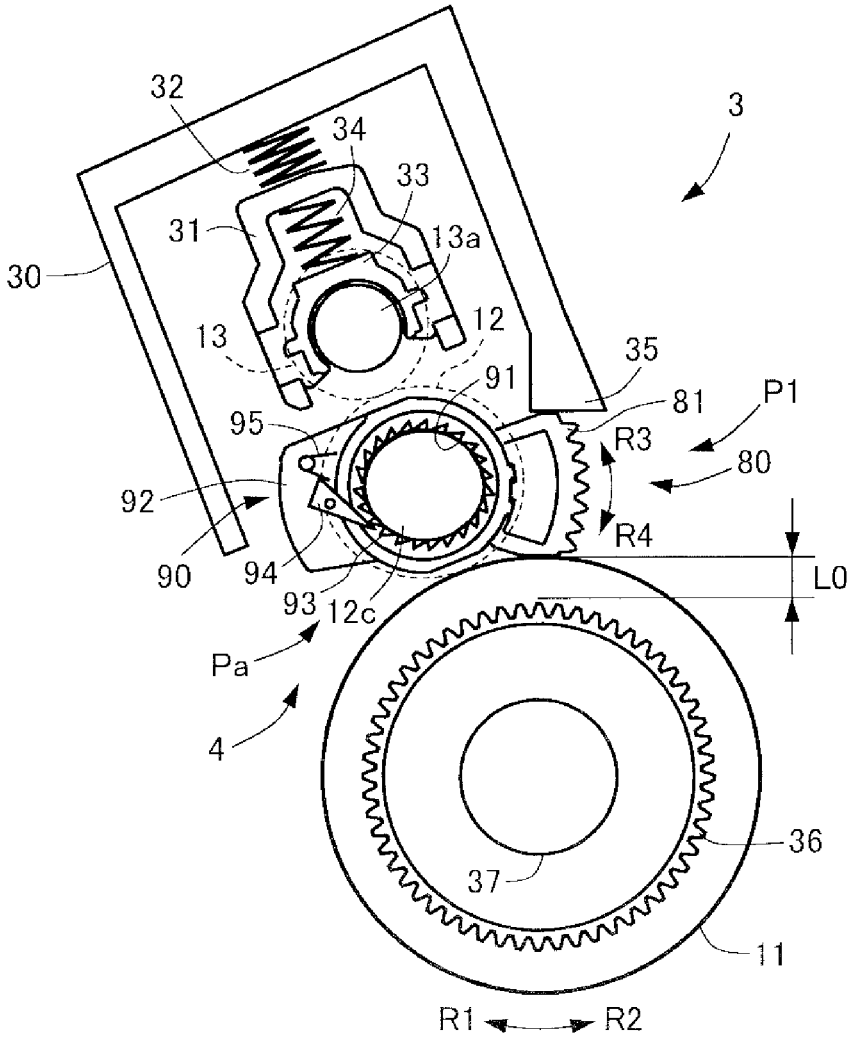
FIG. 13 is a section view schematically illustrating a configuration of a drum cartridge of a second embodiment of the present disclosure.

As illustrated in FIG. 13, the charging roller 12 is disposed above the photosensitive drum 11 in the present embodiment. That is, a gear portion 81 of a separating member 80 is provided to be engageable with a gear portion 36 of a photosensitive drum 11 from an upper side in the gravity direction. In the present embodiment, a predetermined idling torque of a one-way clutch 90 is set to be greater than a rotational moment generated by own weight of the separating member 80 positioned at a first position P1 and acting in the R4 direction for moving the separating member 80 from the first position P1 to a second position P2 (see FIG. 9). That is, while the rotational moment acting in the R4 direction is generated by own weight of the separating member 80 in rotating the separating member 80 in the R3 direction, the separating member 80 can be rotated in the R3 direction because the predetermined idling torque of the one-way clutch 90 is greater than the rotational moment.

Next, an operation for separating the charging roller 12 from the photosensitive drum 11 will be described. Here, an operation in moving the photosensitive drum 11 from the separate position Pb to the contact position Pa (see FIG. 6) after rotating the photosensitive drum 11 in the R2 direction to position the charging roller 12 at the separate position Pb (see FIG. 9) will be described. The photosensitive drum 11 is rotated in the R1 direction in a case of moving the charging roller 12 from the separate position Pb to the contact position Pa. Because the gear portion 36 of the photosensitive drum 11 meshes with the gear portion 81 of the separating member 80 at the separate position Pb, the separating member 80 rotates in the R3 direction from the second position P2 by rotating the photosensitive drum 11 in the R1 direction. Then, as the mesh of the gear portion 36 of the photosensitive drum 11 with the gear portion 81 of the separating member 80 is released, the separating member 80 recedes from the gap between the charging roller 12 and the photosensitive drum 11, and the charging roller 12 comes into contact with the photosensitive drum 11 by an urging force of the pressurizing spring 32. That is, the charging roller 12 moves from the separate position Pb to the contact position Pa.

Here, if the photosensitive drum 11 further rotates normally in the R1 direction, the charging roller 12 pressed and in contact with the photosensitive drum 11 is driven in the R3 direction and the rack gear 93 of the inner diametric portion 91 of the one-way clutch 90 rotates in the R3 direction. At this time, the latch claw 94 does not mesh with the rack gear 93 and is unable to rotate the separating member 80 in the R3 direction. Meanwhile, the separating member 80 tends to rotate downward because a rotational moment caused by own weight acts in the R4 direction, and there is a possibility of causing vibration in the photosensitive drum 11 as the gear portion 81 operates while in contact with the gear portion 36.

Then, the contacting/separating mechanism 4 is arranged to be able to apply sliding friction in idling the charging roller 12 and the separating member 80 exceeding the rotational moment caused by own weight of the separating member 80 in the present embodiment. Specifically, the separating member 80 is provided with a slide portion in contact with the small-diameter portion 12*c* so as to generate and to adjust the sliding friction between the small-diameter portion 12*c* and the separating member 80. This arrangement makes it possible to keep a gap L0 between the separating member 80 and the gear portion 36 provided integrally with the photosensitive drum 11 without bringing these members into contact with each other in forming an image. Therefore, it is possible to reduce image defects such as pitch irregularity of images otherwise caused by the unwanted vibration or the like.

As described above, according to the drum cartridge 3 of the present embodiment, the contacting/separating mechanism 4 can transmit the rotation of the charging roller 12 to the separating member 80 by overcoming the rotational moment caused by own weight of the separating member 80 in a case where the photosensitive drum 11 rotates in the R1 direction. Due to that, even if the charging roller 12 is disposed above the photosensitive drum 11, it is possible to suppress the vibration of the photosensitive drum 11 otherwise caused by the contact of the separating member 80 with the gear portion 36 of the photosensitive drum 11 in forming an image.

According to the present disclosure, it is possible to restrain the vibration of the photosensitive member otherwise caused by the contact of the separating member with the engagement portion of the photosensitive member even though it is possible to switch the contact and the separation of the photosensitive member and the charging roller by the separating member.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-084269, filed Apr. 25, 2019 which is hereby incorporated by reference herein in its entirety.

What is claimed is:

1. An image forming apparatus comprising:

a photosensitive member configured to rotate in a first direction while bearing an electrostatic image in forming an image and in a second direction opposite to the first direction;

a rotary member configured to rotate integrally with the photosensitive member and comprising a first engagement portion on an outer circumferential portion of the rotary member;

a charging roller configured to move to a separate position in which the charging roller is separated from a surface of the photosensitive member and a contact position in which the charging roller is brought into contact with the surface of the photosensitive member, the charging roller being configured to be driven by the photosensitive member at the contact position and charge the surface of the photosensitive member by being applied with voltage;

a separating member comprising a second engagement portion engageable with the first engagement portion and configured to move to a first position and a second position along with rotation of the charging roller, the first position being a position where the second engagement portion separates from the first engagement portion and the separating member allows the charging roller to be positioned at the contact position, the second position being a position where the second engagement portion engages with the first engagement portion and the separating member positions the charging roller at the separate position;

a drive transmission member interposed between the charging roller and the separating member in a power transmission path, the drive transmission member being configured to transmit rotation of the charging roller to the separating member;

a regulating portion configured to regulate the separating member to move beyond the first position by abutting with the separating member at the first position in a case where the photosensitive member rotates in the first direction, wherein, in a case where the photosensitive member rotates in the first direction, the drive transmission member is configured to transmit the rotation of the charging roller to the separating member, move the separating member from the second position to the first position, and idle when the separating member is positioned at the first position by abutting with the regulating portion, and wherein, in a case where the photosensitive member rotates in the second direction, the drive transmission member is configured to transmit the rotation of the charging roller to the separating member and move the separating member from the first position to the second position;

a motor configured to drive the photosensitive member; and a control portion configured to control the motor, wherein the control portion controls the motor such that the photosensitive member is rotated in the first direction at the time of image formation and the photosensitive member is rotated in the second direction at the time of non-image formation to position the separating member at the second position.

2. The image forming apparatus according to claim 1, wherein the photosensitive member comprises a photosensitive drum provided coaxially with the rotary member, wherein the first engagement portion comprises a first mesh portion, wherein the separating member is rotatably provided coaxially with the charging roller, wherein the second engagement portion comprises a second mesh portion meshable with the first mesh portion, and wherein a relationship of $r1+r2<r3+r4$ is satisfied, where r1 is a radius of the photosensitive drum, r2 is a radius of the charging roller, r3 is a radius of a pitch circle of the first mesh portion, and r4 is a radius of a pitch circle of the second mesh portion.

3. The image forming apparatus according to claim 1, wherein, in a case where the photosensitive member rotates in the first direction, the drive transmission member is configured to:

idle without transmitting rotation of the charging roller to the separating member if a torque required for the separating member to move is equal to or greater than a predetermined idling torque, and transmit rotation of the charging roller to the separating member if the torque required for the separating member to move is less than the predetermined idling torque.

4. The image forming apparatus according to claim 3, wherein the second engagement portion engages with the first engagement portion from an upper side with respect to a gravity direction, wherein the separating member is urged by its own weight from the first position to the second position in the gravity direction, and wherein the predetermined idling torque of the drive transmission member is greater than a torque generated by the own weight of the separating member positioned at the first position and acting in a direction of moving the separating member from the first position to the second position.

5. The image forming apparatus according to claim 1, wherein the second engagement portion engages with the first engagement portion from a lower side with respect to a gravity direction.

6. The image forming apparatus according to claim 1, wherein the drive transmission member comprises:

a first cylindrical portion configured to integrally rotate with the charging roller;

a second cylindrical portion provided concentrically with the first cylindrical portion and configured to integrally rotate with the separating member; and a latch mechanism configured to transmit rotation of the first cylindrical portion to the second cylindrical portion in a case where the photosensitive member rotates in the second direction, wherein the latch mechanism is configured to transmit rotation of the first cylindrical portion if a torque required for the separating member to move is less than a predetermined idling torque in a case where the photosensitive member rotates in the first direction, and wherein the latch mechanism is configured to idle without transmitting rotation of the first cylindrical portion with respect to the second cylindrical portion if the torque required for the separating member to move is equal to or greater than the predetermined idling torque in a case where the photosensitive member rotates in the first direction.

7. The image forming apparatus according to claim 1, further comprising an urging portion configured to urge the charging roller to the photosensitive member.

8. The image forming apparatus according to claim 1, wherein, in a case where the photosensitive member rotates in the first direction, a torque required for the separating member to move is less than a predetermined idling torque if the separating member is not in contact with the regulating portion and the drive transmission member transmits rotation of the charging roller to the separating member, and wherein, in a case where the photosensitive member rotates in the first direction, a torque required for the separating member to move is equal to or greater than the predetermined idling torque if the separating member is in contact with the regulating portion and the drive transmission member idles without transmitting rotation of the charging roller to the separating member.

9. The image forming apparatus according to claim 1, further comprising a cleaning roller, being in contact with the charging roller, configured to clean a surface of the charging roller.

10. The image forming apparatus according to claim 1, wherein the second engagement portion comprises a fan-shaped gear.

11. The image forming apparatus according to claim 1, wherein the first and second engagement portions comprise helical gears.

12. The image forming apparatus according to claim 1, further comprising:

a developer bearing member configured to bear and convey developer to a developing area facing the photosensitive member, wherein a length of a moving locus of a part located at the developing area of the photosensitive member in a case where the separating member moves from the first position to the second position while the photosensitive member rotates in the second direction is shorter than a length of a moving locus of a part located at the developing area of the photosensitive member to an area in contact with the charging roller on the photosensitive member while the photosensitive member rotates in the second direction.

13. The image forming apparatus according to claim 1, wherein, after an elapse of a predetermined time from when rotation of the photosensitive member is stopped or after a main power supply is turned off, the control portion controls the motor such that the photosensitive member is rotated in the first direction for a first time to position the separating member at the first position and the photosensitive member is rotated in the second direction for a second time to position the separating member at the second position.

14. The image forming apparatus according to claim 1, wherein the first time is longer than the second time.

15. The image forming apparatus according to claim 1, further comprising a unit frame configured to rotatably support the photosensitive member, wherein the regulating portion is fixed to the unit frame so as not to be movable relative to the unit frame.

* * * * *